US007262001B2

(12) United States Patent
Goto

(10) Patent No.: US 7,262,001 B2
(45) **Date of Patent: *Aug. 28, 2007**

(54) HEAT-DEVELOPABLE PHOTOSENSITIVE MATERIAL AND AN IMAGE FORMING METHOD

(75) Inventor: Narito Goto, Sagamihara (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 82 days.

This patent is subject to a terminal disclaimer.

(21) Appl. No.: 11/045,758

(22) Filed: Jan. 28, 2005

(65) Prior Publication Data

US 2005/0170298 A1 Aug. 4, 2005

(30) Foreign Application Priority Data

Feb. 4, 2004 (JP) ..... 2004-027775

(51) Int. Cl.
*G03C 1/765* (2006.01)
*G03C 1/498* (2006.01)
*G03C 5/29* (2006.01)

(52) U.S. Cl. ..... 430/353; 430/403; 430/496; 430/619; 430/950

(58) Field of Classification Search ..... 430/353, 430/403, 496, 619, 950
See application file for complete search history.

(56) References Cited

U.S. PATENT DOCUMENTS

| | | | | |
|---|---|---|---|---|
| 5,783,380 | A * | 7/1998 | Smith et al. | 430/619 |
| 5,866,504 | A * | 2/1999 | Okada et al. | 503/200 |
| 6,130,033 | A * | 10/2000 | Defieuw et al. | 430/619 |
| 6,548,232 | B2 * | 4/2003 | Goto | 430/350 |
| 6,749,999 | B2 * | 6/2004 | Yabuki et al. | 430/353 |
| 2003/0091347 | A1 * | 5/2003 | Goto et al. | 396/564 |
| 2003/0207216 | A1 * | 11/2003 | Fukui et al. | 430/350 |
| 2003/0215756 | A1 * | 11/2003 | Morita et al. | 430/350 |
| 2004/0229175 | A1 * | 11/2004 | Goto | 430/542 |

* cited by examiner

*Primary Examiner*—Richard L. Schilling
(74) *Attorney, Agent, or Firm*—Frishauf, Holtz, Goodman & Chick, P.C.

(57) ABSTRACT

A heat-developable photosensitive material comprising a support, providing thereon, an organic silver salt, silver halide, a binder and a reducing agent, wherein a value of Rz(E)/Rz(B) is from 0.1 to 0.7 in which Rz(E) is the ten-point average roughness of the outermost surface of the image forming layer side and Rz(B) is the ten-point average roughness of the outermost surface of the side of the support opposite to the side of the image forming layer.

14 Claims, 1 Drawing Sheet

HEAT-DEVELOPABLE PHOTOSENSITIVE MATERIAL AND AN IMAGE FORMING METHOD

FIELD OF THE INVENTION

The present invention relates to a heat-developable photosensitive material and in detail to a heat-developable material giving high density image and excellent in the tone of silver image, the storage ability of image against light irradiation and the preventing ability of fog increasing during the storage, and an image forming method employing the same.

TECHNICAL BACKGROUND

Hitherto, in the field of medicine and presswork, the waste liquid accompanied with the wet processing causes a problem on the working efficiency. Furthermore, it is strongly demanded to reduce the amount of the waste liquid from the view point of the environment protection and the space saving. Consequently, the heat-developable photosensitive material has been put to practical use and has been rapidly spread in the forgoing fields.

The heat-developable photosensitive material has been proposed a long time ago, for example, in U.S. Pat. Nos. 3,152,904 and 3,457,075.

The heat-developable photosensitive material is usually treated by a thermally developing processing apparatus, so-called a heat developing processor, for forming an image by stably providing heat to the heat-developable photosensitive material. As above-mentioned, a lot of the thermally developing processor is supplied to the market accompanied with the rapidly spreading in recent years. However, a problem is caused that the insufficient conveying of the photosensitive material and the unevenness of image density are caused by the variation of the slipping property between the heat-developable photosensitive material and the conveying roller or the treating member of the thermally developing processor depending on the thermal and humidity condition on the occasion of the thermally developing treatment. Moreover, a problem is posed that the image density of the heat-developable photosensitive material is varied accompanying with passing of the storage time. It has been found that such the problems are considerably posed in the heat-developable photosensitive material which is thermally developed to forming an image after imagewise exposure by laser light.

It has been recently demanded to make compact the laser imager and to make rapid the processing. For obtaining the sufficient image density of the heat-developable photosensitive material by applying a rapid processing, it is effective to use silver halide having a small average diameter to increase the number of color forming point so as to raise the covering power as described, for example, in Japanese Patent Publication Open to Public inspection, hereinafter referred to as Tokkai, Nos. 11-295844 and 11-352627, or to apply a highly active reducing agent having a secondary or tertiary alkyl group or a development accelerator such as a phenol compound, hydrazine compound and vinyl compound.

Recently, it is further demanded to make compact the laser imager, to raise the precise of image and to prevent the increasing of fogging during storage. For example, Tokkai No. 2000-305213 discloses a technique in which no spectral sensitizing dye is used for preventing the fogging during the storage and the exposure is carried out by ultraviolet or blue laser light. Furthermore, Tokkai No. 2003-91053 discloses a technique in which exposure is carried out by laser light having an emission peak within the range of from 350 nm to 450 nm for miniaturizing the apparatus. However, the problem of occurrence of the default of conveying on the occasion of thermal development and the unevenness of image density is posed when the compact apparatus is employed or the rapid processing is applied even when the above techniques are applied. The improvement on the fogging during the storage is also insufficient.

SUMMARY OF THE INVENTION

The invention is attained in consideration of the forgoing problems. An object of the invention is to provide an image forming method by which an image having high density and the fault of conveying and the unevenness of image density are prevented and the fogging during storage is improved. Moreover, according to necessity, another object of the invention is to prevent an image forming method excellent in the storage ability of the image during storage at a high temperature and in the conveying ability and the suitability to the environmental conditions of the film.

As a result of investigation, it is found that the above-mentioned object can be satisfied by making the surface roughness of the image forming layer side and the back-coating side into the specified range even when the apparatus is miniaturized by the use of a laser emitting light having the intensity peak within the wavelength range of from 350 nm to 450 nm, and the rapid processing is further applied. Thus the present invention is attained.

The foregoing object can be attained by the following constitution.

1. A heat-developable photosensitive material having an image forming layer containing organic silver salt, silver halide, binder and a reducing agent, wherein a value of Rz(E)/Rz(B) is from 0.1 to 0.7, in which Rz(E) is the ten-point average surface roughness of the outermost surface of the image forming layer side on a support and Rz(B) is the ten-point average surface roughness of the outermost surface of the opposite side through the support.

2. The heat-developable photosensitive material of the above item 1, wherein the value of Rz(E)/Rz(B) is from 0.2 to 0.6.

3. The heat-developable photosensitive material of the above item 2, wherein the value of Rz(E)/Rz(B) is from 0.3 to 0.5.

4. The heat-developable photosensitive material of the above item 1, wherein Lb/Le is from 2.0 to 10 in which Lb is a layer included in the layer on the image forming layer side of the support and Le is the average particle size of a matting agent having the largest average particle size contained in a layer on the opposite side through the support.

5. The heat-developable photosensitive material of the item 1, wherein the value of Ra(E)/Ra(B) is from 0.5 to 1.5 when Ra(E) is the center-line average surface roughness of the surface of the image forming layer side and Ra(B) is the center-line average surface roughness of the surface of the opposite side through the support.

6. The heat-developable photosensitive material of the above item 1, wherein the value of Rz(E)/Ra(E) is from 10 to 70.

7. The heat-developable photosensitive material of the above item 1, wherein the silver halide contains silver iodide in a ratio of from 5 mole-percent to 100 mole-percent.

8. The heat-developable photosensitive material of the item 1, wherein the silver halide contains silver iodide in a ratio of from 40 mole-percent to 100 mole-percent.

9. The heat-developable photosensitive material of claim 1, a silver saving agent selected from the group consisting of a vinyl compound, a hydrazine derivative, a phenol derivative, a naphthol derivative, a silane compound and a quaternary onium compound is contained in the image forming layer side.

10. The heat-developable photosensitive material of claim 1, wherein the glass transition point (Tg) of the binder is from 70 to 150° C.

11. The heat-developable photosensitive material of the above item 1, wherein the heat-developable photosensitive material contains a compound represented by Formula SF;

$$(Rf(L)n1)p(Y)m1(A)q \qquad \text{Formula SF}$$

in which Rf is a substituent having a fluorine atom, L is a di-valent linking group having no fluorine atom, Y is a (p+q)-valent linking group having no fluorine atom, m1 and n1 are each an integer of 0 or 1 and p and q are each an integer of 1 to 5, provided that n1 and m1 are not simultaneously 0 when q is 1.

12. The heat-developable photosensitive material of the above item 1, wherein the silver halide contains silver halide grains having an average grain size of from 10 to 50 nm.

13. The heat-developable photosensitive material of the above item 1, wherein the silver halide further contains silver halide grains having an average grain size of from 55 to 100 nm.

14. The heat-developable photosensitive material of the above item 1, wherein the silver halide contains a silver halide grain chemically sensitized by a charcogen compound.

15. The heat-developable photosensitive material of the above item 1, wherein the amount of silver contained in the image forming layer is from 0.3 to 1.5 $g/m^2$.

16. An image forming method comprising a step of exposing the heat-developable photosensitive material of the above item 1 by a light source of a laser having an emission peak at 350 nm to 450 nm.

17. The image forming method of the above item 16, characterized in that, regarding a characteristic curve indicated on an orthogonal coordinate in which a diffuse density (Y-axis) and exposure amount in common logarithm (X-axis) are of the same unit length, a mean gradient y (Ga) of an image formed by thermal development at a developing temperature of 123° C. for a developing time of 13.5 seconds is in a range from 2.0 to 4.0 with a range of optical density from 0.25 to 2.5 with diffusion light.

18. The image forming method of the above item 16, wherein the thermal development is carried out by the use of a thermal developing apparatus at a conveying rate in a developing part of from 10 to 200 mm/seconds, a conveying rate between a photographic material supplying part to a imagewise exposing part of from 10 to 200 mm/second and a conveying rate in the imagewise exposing part of from 10 to 200 mm/second.

19. The image forming method of the above item 16, wherein the heat-developable photosensitive material is exposed to light having an illuminance of not less than 1 $mW/mm^2$.

An image forming method can be provided by the invention, by which an image having high density and the fault of conveying and the unevenness of image density are prevented and the fogging during storage is improved. Moreover, according to necessity, an image forming method excellent in the storage ability of the image during storage at a high temperature and in the conveying ability and the suitability on the environmental conditions of the film can be provided by the invention.

THE BEST EMBODIMENT OF THE INVENTION

Figure 1:
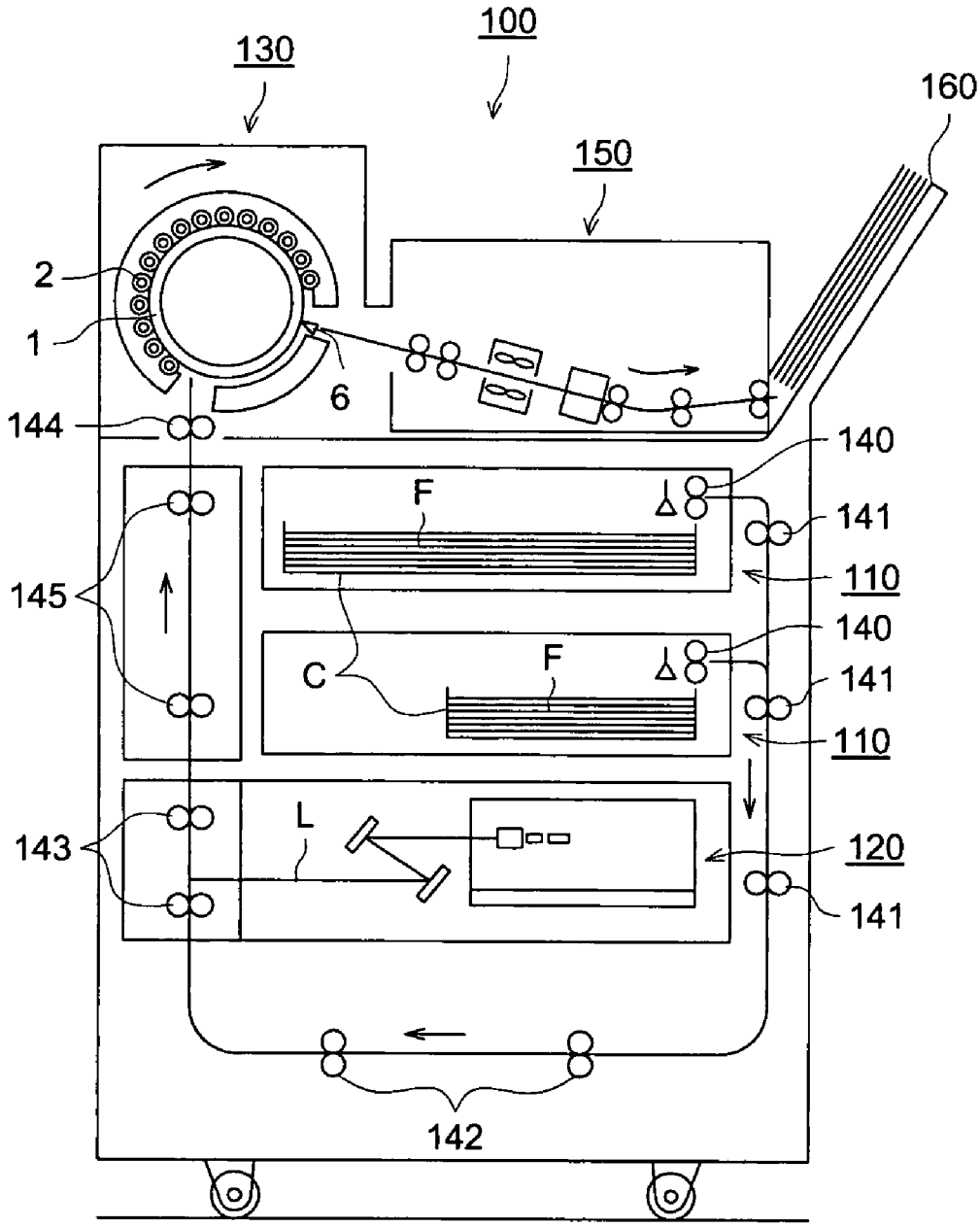
FIG. 1 shows an example of the thermally developing apparatus for processing the heat-developable photosensitive material of the invention.

The invention is described in detail below. An image having high image density and without occurrence of the fault of conveying and the unevenness of density and excellent in the fogging during storage can be obtained by the image forming method of above item 16 employing the heat developable photosensitive material of the items of from 1 through 5.

The image density can be considerably raised by the use of the heat-developable photosensitive material of the above item 7.

The storage ability of the image during storage at high temperature can be further improved by the use of the heat-developable photosensitive material of the item 8.

The conveying ability of the film and the suitability to the environment (reducing of the accumulation in an organism) can be improved by the use of the heat-developable photosensitive material of the item 9.

In the item 10, the average grain size is preferably from 10 to 40 nm, and more preferably from 10 to 35 nm. The average grain size of less than 10 nm sometimes causes lowering of the image density and degradation in the durability of the image against to light irradiation. When the average grain size exceeds 50 nm, lowering in the image density is sometimes caused.

The average grain size is defined by the length of the side of the grain when the silver halide grain is a cubic or octahedral crystal so called a regular crystal. When the silver halide grain is a planar grain, the grain size is the diameter of a circle having the same area as that of the projection image of the principal face. When the grain is not regular crystal such as a spherical grain or a rod-shaped grain, the grain size is the diameter of a sphere having the same volume as that of the silver halide grain. The measurement of the diameter is performed by employing an electron microscope, and the average grain size is determined by averaging the measured value of 300 grains.

In the item 11, control of the gradation, improvement of the image density and improving (reducing) the lowering in the course of the storage can be attained by the combination use of silver halide grains having an average grain size of from 55 to 100 nm and silver halide grains having an average grain size of from 10 to 50 nm. The ratio in weight of the silver halide grains having an average grain size of from 55 to 100 nm to the silver halide grains having an average grain size of from 10 to 50 nm is preferably from 95:5 to 50:50, and more preferably from 90:10 to 60:40.

The constituting elements of the invention are described in sequence below.

Organic Silver Salt

The organic silver salt as the silver ion supplying source for silver image formation is preferably silver salt of an organic acid or a hetero organic acid, particularly silver salt of a long chain (having 10 to 30, and preferably from 15 to 25 carbon atoms) aliphatic carboxylic acid or that of a nitrogen-containing heterocyclic compound. Organic or inorganic complexes having an overall stability constant of from 4.0 to 10.0 are also preferable, which are described in Research Disclosure, herein after referred to as RD, Nos. 17029 and 29963. Preferable examples of such the silver salt are described below.

The examples include a silver salt of organic acid such as silver salt of gallic acid, oxalic acid, behenic acid, stearic acid, arachidic acid, palmitic acid and lauric acid; a silver salt of a carboxyalkylthiourea such as silver salt of 1-(3-carboxypropyl)thiourea and 1-(3-carboxypropyl)-3,3-dimethylthiourea; a silver salt or complex of a polymerized product of an aldehyde and a hydroxyl-substituted aromatic carboxylic acid such as the silver salt or complex of a reaction product of aldehyde such as formaldehyde, acetoaldehyde and butylaldehyde, and the hydroxy-substituted acid such as salicylic acid, benzoic acid and 3,5-dihydroxybenzoic acid; a silver salt or complex of a thione such as the silver salt or complex of 3-(2-carboxyethyl)-4-hydroxymethyl-4-thiazoline -2-thione and 3-carboxymethyl-4-thiazoline-2-thione; a silver complex or salt of a nitrogen-containing acid selected from imidazole, pyrazole, urazole, 1,2,4-thiazole, 1H-tetrazole, 3-amino-5-benzylthio-1,2,4-triazole and benzotriazole; a silver salt of saccharine and 5-chloroalicylaldoxime; and a silver mercaptide.

Among them, the silver salt of aliphatic carboxylic acid having a long chain (having from 10 to 30, preferably from 15 to 25, carbon atoms) such as silver behenate, silver arachidate and silver stearate are particularly preferred.

In the invention, it is preferable that two or more kinds of the organic silver salt are mixed for forming a silver image having high density and high contrast. For example, the silver salt mixture is preferably prepared by mixing a silver ion solution with a mixture of two or more kinds of the organic acid.

The organic silver salt is obtained by mixing a water-soluble silver compound with a compound capable of forming a complex with silver. For the mixing, a normal mixing method, a reversal mixing method, a double-jet mixing method and a controlled double-jet mixing method such as that described in Tokkai No. 9-127643 are preferably applied. For example, an alkali metal salt or soap such as sodium behenate and sodium arachidate is prepared by adding an alkali metal salt such as sodium hydroxide and potassium hydroxide to the organic acid, and then the soap is mixed with silver nitrate by the controlled double-jet method to form organic acid salt crystals. On this occasion, silver halide grains may be mixed therewith.

The organic silver salt having various shapes may be employed, and a tabular particle is preferred. Particularly, a tabular organic silver salt particle having an aspect ratio of not less than 3 and an average value of needle shape ratio measured in the direction of the principal face of from 1.1 to less than 10.0, more preferably from 1.1 to less than 5, is preferred for raising the filling ratio in the photosensitive layer by reducing the shape anisotropy of two faces (principal faces) each having the largest area and facing to each other in approximate parallel.

The terms that "the organic silver salt particles are the tabular organic silver salt particles having an aspect ratio of not less than 3" means that such the tabular particles account for not less than 50% of the whole number of the organic silver salt particles. The ratio of the tabular particles having an aspect ratio of not less than 3 to the whole number of the organic silver salt particle is preferably not less than 60%, more preferably not less than 70%, further preferably not less than 80%, and particularly not less than 90%.

The tabular particle having an aspect ration of not less than 3 is a particle having the ratio of the diameter to the thickness of the particle, the so-called aspect ratio or AR, of not less than 3.

$$AR = \text{particle diameter } (\mu m)/\text{particle thickness } (\mu m)$$

The aspect ratio of the tabular organic silver salt particle is preferably from 3 to 20, and more preferably from 3 to 10. When the aspect ratio is too low, the organic silver salt particles tend to be crowded, and when that is too high, the organic silver salt particles tend to be overlapped and dispersed in the stuck state, therefore, light scattering is tend to occur and lowering in the transparency of the heat-developable photosensitive material is caused.

The particle diameter, the average thickness and the ratio of the average ratio of needle-shaped particle can be determined by the method described in Tokkai No. 2000-287299, paragraphs 0031 through 0047.

Though the method for obtaining the organic silver salt particle having the foregoing shape is not specifically limited, it is effective to suitably keep the mixing condition on the occasion of the formation of the organic alkali metal soap or addition of the silver nitrate to the soap, and to suitably make the ratio of silver nitrate reacting with the soap.

The tabular organic silver salt particle relating to the invention is preferably dispersed and crashed by a media dispersing apparatus or a high pressure homogenizer after the preliminary dispersion together with the binder and a surfactant according to necessity. A usual stirrer such as an anchor type and a propeller type, a high speed rotation centrifugal emission type stirring machine (dissolver) and a high speed rotation shearing stirring machine (Homomixer) are applicable for the preliminary dispersion.

As the media dispersing machine, a rotating mill such as a ball mill, a planet ball mill and a vibration ball mill, a medium stirring mill such as a beads mill and an attriter, and a basket mill are employable. As the high pressure homogenizer, various types of machine can be employed such as a type in which the liquid is struck to a wall or a plug, a type in which the liquid is divided to several streams and struck the liquid streams with together in high speed and a type in which the liquid is passed through a thin orifice.

As the ceramics employed for the ceramic beads to be used for the media dispersion, those described in Tokkai No. 2002-287299, paragraph 0045, are preferred. Yttrium-stabilized zirconia and zirconia-strengthen alumina (hereinafter, the ceramic containing zirconia is referred to as zirconia) are preferably employed since the formation of the impurity caused by friction of the beads and the dispersing machine on the occasion of the dispersion is small.

In the apparatus to be used for dispersing the tabular organic silver salt particle, it is preferable to employ a ceramic such as zirconia, alumina, silicon nitride and boron nitride or diamond for the material at the portion where the organic silver salt is touched. Among them, the use of zirconia is referred.

It is preferable on the occasion of the dispersion that the concentration of the binder is from 0.1 to 10% by weight of the organic silver salt and the liquid temperature is not over 40° C. through the preliminary dispersion and the principal dispersion. The preferable condition for the principal dispersion is from 29.42 to 98.06 MPa when the high pressure homogenizer is employed as the dispersing means, and the operation is preferably performed twice. When the media dispersing machine is employed as the dispersing means, the circumference speed is preferably from 6 to 13 m/second. In the preferable embodiment of the heat-developable photosensitive material according to the invention, a photosensitive emulsion containing is coated, which contains a photosensitive silver halide emulsion and the organic silver salt is coated, in which the ratio of the organic silver salt particles having a projection area of less than 0.025 $\mu m^2$ to the whole projection area of the organic silver salt particles is not less than 70% and the ratio of the particle having a projection area of not less than 0.2 $\mu m^2$ is not more than 10% when the cross section vertical to the support of the photosensitive material is observed by an electron microscope. In such the case, the coagulation of the organic silver salt particles is small so that the uniformly dispersed state can be obtained.

Though the condition for preparing such the photosensitive emulsion is not specifically limited, preferable conditions are to suitably keep the mixing condition on the occasion of the formation of the organic alkali metal soap or addition of the silver nitrate to the soap, to suitably make the ratio of silver nitrate reacting with the soap, to use the media dispersing apparatus or the high pressure homogenizer for dispersing, to make the using amount (concentration) of the binder to from 0.1 to 10% by weight of the organic silver salt, to keep the temperature at not more than 45° C. until finishing or the principal dispersion, and to stir the liquid at a circumference speed of not less than 2.0 m/second by the dissolver on the occasion of the preparation.

The projection area of the organic silver salt particle having the specified projection area and the ratio of the area of such the particles to the entire projection area are measured by extracting the portion of the organic silver salt particle by the method using a transmission electron microscope TEM the same as that described for measuring the average thickness of the particles. In concrete, the measurement can be performed according to the method described in Tokkai No. 2002-287299, paragraphs 0075 through 0059.

The organic silver salt particle to be employed in the invention is preferably a monodispersed particle, and the preferable monodispersion degree is from 1 to 30%. High image density can be obtained by the use of such the monodispersed particles. The monodispersion degree is defined by the following expression.

$$\text{Monodispersion degree}=\{(\text{Standard deviation of particle diameter})/(\text{Average particle diameter})\}\times 100$$

The average diameter (circle equivalent diameter) of the above-mentioned organic silver salt particles is preferably from 0.01 to 0.3 μm, and more preferably from 0.02 to 0.2 μm. The circle equivalent diameter is the diameter of a circle the same as the individual particle image area observed by the electron microscope.

To prevent hazing the heat-developable photosensitive material, the total amount of the silver halide and the organic silver salt is preferably from 0.3 to 1.5 g in terms of silver per square meter. Suitable image for medical use can be obtained by making the silver amount to the above value. When the amount is less than 0.3 g per square meter, the image density is tend to be lowered. When the amount exceeds 1.5 g, fog tends to be increased and the sensitivity is lowered when the image is printed to a PS plate.

Silver Halide

The silver halide to be used in the invention, hereinafter referred to as photosensitive silver halide grain or silver halide grain, is described below. In the invention, the silver halide is a silver halide crystal grain produced so as to be capable of absorbing light in itself as the inherent property of silver halide or capable of absorbing visible or infrared light by an artificial chemical or physical treatment, and capable of occurring physicochemical variation on the interior or the surface thereof when the crystal absorbs any region of light within the range of from visible to infrared.

The silver halide grain can be prepared by a known method as emulsion of silver halide, also called as silver halide emulsion. The silver halide grain may be produced by any method such as an acidic method, a neutral method and an ammoniacal method are applicable, and a single-jet mixing method, a double-jet mixing method and a combination thereof may be utilized for mixing a soluble silver salt with a soluble halide. Among them, a method so-called a controlled double-jet method is preferred, in which the emulsion formation is performed while controlling the condition.

The silver halide grain having a silver iodide content of from 5 mole-percent to 100 mole-percent is preferable as the halide composition of the silver halide grain relating to the invention. The distribution of the halide composition in the grain may be uniform, stepwise varied or continuously varied. A silver halide grain having a core/shell structure is also preferably-employed, in which the iodide content is higher interior or exterior of the grain. A core/shell grain having two- to five-layered structure is preferable; one having two- to four-layered structure is more preferable. The preferable iodide content of the emulsion to be employed in the invention is from 10 mole-percent to 100 mole-percent. The iodide content is more preferably from 40 mole-percent to 100 mole-percent, further preferably from 70 mole-percent to 100 mole-percent, and particularly preferably from 90 mole-percent to 100 mole-percent. The silver halide according to the invention is preferably one having direct transition absorption between 350 nm to 440 nm caused by the silver iodide crystal structure. The presence of the light absorption by the direct transition in the silver halide can be easily distinguished by the exciton absorption caused by the direct transition near 400 nm to 430 nm. Preferable methods for introducing silver iodide to the silver halide grain are a method of addition of an alkali iodide solution in the course of the silver halide grain formation, a method of addition of at least one of a silver iodide fine grain, a silver iodobromide fine grain, a silver iodochloride fine grain and a silver iodochlorobromide, and a method using an iodide releasing agent described in Tokkai Nos. 5-323487 and 6-11780.

The formation of the grain is usually divided to two steps for forming of silver halide seed grain (nucleus) and for growing of the grain; these steps may be either preformed continuously at once or separately to the formation of the nucleus (seed grain) and the growth of the grain. The controlled double-jet method in which the grain forming conditions such as pAg and pH are controlled in the course of the grain formation is preferred since the shape and the size of the grain can be controlled. For example, in the case of that the nucleus formation and the grain growth are separately performed, the nucleus or seed grain is formed by uniformly and rapidly mixing an aqueous solution of silver salt and an aqueous solution of halide in an aqueous solution of gelatin (nucleus formation process), and then the silver halide grain is produced by a grain growing process in which an aqueous solution of silver salt and an aqueous solution of halide is supplied while controlling the pAg and pH. After formation of the grain, unnecessary salts are removed in a desalting process by a known desalting method such as a noodle method, a flocculation method, an ultrafiltration method and electrodialysis method. Thus desired silver halide emulsion can be obtained.

The grain size of the silver halide emulsion has preferably monodispersed distribution. Here, the term of "monodispersed" means that the variation coefficient of the grain size calculated by the following expression is not more than 30%, preferably not more than 20%, and further preferably not more than 15%.

Variation coefficient of grain size=(Standard deviation of grain diameter/Average grain diameter)×100

The shape of the silver halide grain includes cubic, octahedral, tetradecahedron, tabular, spherical, rod-shape and potato-shape. Among them, the cubic grain, octahedral grain, tetradecahedral grain and tabular grain are particularly preferred.

When the tabular silver halide grain is employed, the average aspect ratio of the grain is preferably from 1.5 to 100, and more preferably 2 to 50. U.S. Pat. Nos. 5,264,337, 5,314,798 and 5,320,958 describe about such the grain, and the objective tabular grain can be easily obtained. Moreover, silver hailed grain having rounded corner is also preferably employed.

Though the crystal habit of the outer surface of the silver halide grain is not specifically limited, it is preferable to employ the silver halide grains containing a grain having the crystal habit suitable for the selectivity of the dye in relatively high ratio when a sensitizing dye having crystal habit (face) selectivity,. For example, when a sensitizing dye selectively adsorbed on the face of Miller index [100] is employed, it is preferable that the occupying ratio of the face [100] on the outer surface of silver halide grain is high; the ratio is preferably not less than 50%, more preferably not less than 70%, and particularly preferably not less than 80%. The ratio of the face of Miller index [100] can be determined by utilizing the adsorption dependency of the sensitizing dye on the face [111] and the face [100] described on T. Tani; J. Imaging Sci., 29, 165 (1985).

The silver halide grain to be employed in the invention is preferably produced by using low molecule weight gelatin having a molecular weight of not more than 50,000, and it is particularly preferred that such the gelatin is used on the occasion of the nucleus formation. The molecular weight of the low molecular weight gelatin is preferably not more than 50,000, more preferably from 2,000 to 40,000, and particularly preferably from 5,000 to 25,000. The average molecular weight of the gelatin can be measured by gel filtration chromatography. The low molecular weight gelatin can be obtained by subjecting an aqueous solution of usual gelatin having an average molecular weight approximately 100,000 to enzyme decomposition by addition of a gelatin decomposing enzyme, hydrolysis by addition of an acid or an alkali and heating, thermal decomposition by heating under atmospheric pressure or high pressure, decomposition by applying ultrasonic wave or the combination of the above methods.

The concentration of the dispersing medium on the occasion of the nucleus formation is preferably not more than 5% by weight, and more preferably from 0.05 to 3.0% by weight.

In the silver halide grain to be employed in the invention, the grain formation is preferably performed in the presence of the following formula.

$$Y^1O(CH_2CH_2O)_{m2}[CH(CH_3)CH_2O]_{p2}(CH_2CH_2O)_{n2}Y_1$$

In the above formula, $Y^1$ is a hydrogen atom, an $—SO_3M^1$ group or a $—CO—B^1—COOM^1$ group; $M^1$ is a hydrogen atom, an alkali metal atom, an ammonium group or an ammonium group substituted by an alkyl group having not more than 5 carbon atoms; and $B^1$ is a chain or cyclic forming an organic dibasic acid; $m_2$ and $n_2$ are each an integer of from 0 to 50 and $p_2$ is an integer from 1 to 100.

The polyethylene oxide represented by the above formula has been employed as the defoaming agent for preventing foam considerably formed in the process for preparing an aqueous gelatin solution, the process for adding a water-soluble halide compound and a water-soluble silver salt to the gelatin solution, and the process for coating the emulsion on a support, in such the processes the raw materials of emulsion are stirred or moved. The technique for applying the compound as the defoaming agent is described in, for example, Tokkai No. 44-9497. The polyethylene oxide compound also functions as the defoaming agent on the occasion of the nucleus formation.

The compound represented by the above formula is preferably employed in an amount of not more than 1%, and more preferably from 0.01 to 0.1%, by weight of silver.

Regarding the nucleus forming condition, the method described in Tokkai No. 2002-187299, paragraph 0079, can be referred.

As the photosensitive silver halide grain, the silver halide grain described in Tokkai No. 2003-270755 is usable, the surface sensitivity of which is lowered by conversion of from the surface latent image type to interior latent image type the thermal development. In such the silver halide grain, the latent images capable of functioning as the catalyst for the development reaction (the reducing reaction of a silver ion by a silver ion reducing agent) are formed on the surface of the silver halide grain by exposing before thermal development, and more latent images are formed at the interior than the surface of the grain by the exposure after the thermal developing treatment so that the latent image formation at the grain surface is inhibited.

The silver halide grain may be added to the image forming layer by any methods; it is preferred that the silver halide is arrange so as to near the silver source (organic silver salt) capable of being reduced.

It is preferable that the silver halide grain is previously prepared and added to the solution for producing the organic silver salt since the silver halide preparation process and the organic silver salt preparation process can be separately performed, but it may be possible that a halide component such as a halide ion is mixed with the organic silver salt forming component and silver ion is poured therein to form the silver halide grain together with the organic silver salt particle almost simultaneously such as described in British Patent No. 1,44,454.

It is also possible to form silver halide grain by conversion of the organic silver salt by affecting a halogen-containing compound. Namely, a part of organic silver salt can be converted to the photosensitive silver halide by affecting a silver halide forming component to a solution or dispersion of the preliminary prepared organic silver salt or a sheet containing the organic silver salt.

An inorganic halogen compound, an onium halide, a halogenized hydrocarbon, an N-halogen compound and another halogen-containing compound are employable as the above silver halide forming component. Concrete examples are described in Tokkai No. 2002-287299, paragraph 0086.

As above-described, the silver halide can be formed by conversing a part or entire of silver in the organic silver salt by reaction of the organic silver salt with halogen ion. Moreover, the separately prepared silver halide grains may be employed together with the silver halide grains prepared by the conversion of a part of the organic silver salt.

The preferable employing amount of the separately prepared silver halide grains and that of the silver halide grains prepared by the conversion of the organic silver salt are also from 0.001 to 0.7 moles, and more preferably from 0.03 to 0.5 moles, per mole of the organic silver salt.

It is preferable that the silver halide contains transition metal included in Group 6 through 11 of the periodic table. W, Fe, Co, Ni, Cu, Ru, Rh, Pd, Re, Os, Ir, Pt and Au are preferred as such the metal. The metals may be employed solely or in combination of two or more kinds of metal complexes of the same kind or different kind of metal. These metal ions may be introduced in the silver halide in a state of metal salt, metal complex or metal complex ion. The content of the metal is preferably from $1\times10^{-9}$ to $1\times10^{-2}$ moles, and more preferably from $1\times10^{-8}$ to $1\times10^{-4}$ moles, pre mole of silver. In the invention, the transition metal complexes or the complex ions represented by the following formula are preferred.

$$[ML_6]_m \qquad \text{Formula}$$

In the above formula, M is a transition metal selected from the elements of Groups 6 through 11 of the periodic table, L is a ligand, and m is 0, -, 2-, 3- or 4-. Examples of ligand represented by L are a halogen ion such as fluorine ion, a chlorine ion, a bromine ion and an iodine ion, a cyanide group, a cyanate group, a thiocyanate group, a selenocyanate group, a tellurocyanate group, an azide group, an aquo ligand, a nitrosyl group and a thionitrosyl group. When the aquo ligand exists, the aquo ligand preferably occupied one or two of the ligands. The ligands represented by L may be the same or different.

It is preferable that the ion of such the metal or the compound supplying the complex ion is included in the silver halide grain by adding the ion or the compound on the occasion of the silver halide grain formation. Though the ion or the compound may be added at any steps of the preparation, namely the nucleus formation, growing, physical ripening and after and before chemical sensitization of the grain, the addition at the step of the nucleus formation, growing or physical ripening is preferable and the addition at the step of the nucleus formation or growing is more preferable and the addition at the step of the nucleus formation is most preferable. The ion or the compound may be separately added for several times or added so that the ion or the compound is uniformly contained in the silver halide grain. The ion or the compound may be contained in the silver halide grain so as to have a desired distribution such as that described in Tokkai Nos. 63-29603, 2-306236, 3-167545, 4-76534, 6-110146 and 5-273683.

Such the metal compound can be added by dissolving in water or a suitable organic solvent such as alcohols, ethers, glycols, esters or amides. For example, the following methods are applicable; a method in which a solution of the metal compound powder, or a solution of the metal compound together with sodium chloride or potassium chloride is added to the water-soluble silver salt solution or the water-soluble halide solution on the occasion of the grain formation, a method in which the silver halide grain is formed by simultaneously mixing of three solutions, namely the silver salt aqueous solution, the halide aqueous solution and the metal compound solution as the third solution, a method in which the necessary amount of the aqueous solution of the metal compound is put into the reaction vessel during the formation of the silver halide grain, and a method in which a separately prepared silver halide grain doped with the metal ion or the metal complex ion is added and dissolved on the occasion of the silver halide grain formation. Particularly, the method of adding the solution of the metal compound powder or the solution of the metal compound together with sodium chloride or potassium chloride to the halide aqueous solution is preferred. The necessary amount of the metal compound may be added to the reaction vessel just after the grain formation, in the course or at the finish of the physical ripening, or in the occasion of the chemical ripening for containing the metal at the surface of the silver halide grain.

Though the separately prepared silver halide grain may be desalted by a known desalting method such as a noodle method, a flocculation method, an ultrafiltration method and electrodialysis, the silver halide grain not desalted can be employed in the heat-developable photosensitive material.

The silver halide grain may be subjected to chemical sensitization. For example, a chemical sensitization center (chemical sensitization nucleus) can be formed by employing a compound containing a charcogen atom such as sulfur or a noble metal compound releasing a noble metal atom such as gold according to the methods described in, for example, Tokkai Nos. 2001-249428 and 2001-249426. In the invention, the chemical sensitization by the combination of the chemical sensitization by the charcogen atom containing compound and that by the noble metal compounds is particularly preferred.

In the invention, it is preferable that the silver halide grain is chemically sensitized by the following compound containing the charcogen atom. The compound containing the charcogen atom suitable for the chemical sensitizer is preferably a compound having a group capable of adsorbing to silver halide and a labile charcogen atom moiety.

Organic sensitizers having various structures disclosed in Tokkai Nos. 60-150046, 4-109240 and 11-218874 can be employed, and the sensitizer is preferably at least one of compounds having a structure in which the charcogen atom is bonded with a carbon atom or a phosphor atom by a double bond. The compounds represented by Formula (1-1) or (1-2) disclosed in Tokkai No. 2002-250984 are particularly preferred.

The employing amount of the charcogen atom-containing compound as the organic sensitizer is preferably from $1\times10^{-8}$ to $1\times10^{-2}$ moles, and more preferably from $1\times10^{-7}$ to $1\times10^{-3}$ moles, per mole of silver even though the amount is varied depending on the kind of the charcogen compound, silver halide grain and the reaction condition on the occasion of the chemical sensitization. Though there is no limitation to the environment of the chemical sensitization, it is preferable that the charcogen sensitization is performed in the presence of a compound capable of disappearing or decreasing the size of the silver charcogenide or silver nucleus, particularly in the presence of an oxidizing agent capable of oxidizing the silver nucleus. The sensitization is preferably carried out under a condition of pAg of from 6 to 11, and more preferably from 7 to 10 and pH of from 4 to 10, and more preferably from 5 to 8, and a temperature of not more than 30° C.

Consequently, in the heat-developable photosensitive material according to the invention, it is preferable to employ the photosensitive silver halide emulsion in which the photosensitive silver halide is chemically sensitized by the organic sensitizer containing the charcogen atom in the presence of the oxidizing agent capable of oxidizing the silver nucleus on the silver halide grain at a temperature of not more than 30° C., and the silver halide grain is mixed and dispersed with the organic silver salt and dehydrated and dried.

The chemical sensitization employing such the organic sensitizer is preferably carried out in the presence of a hetero atom-containing compound having absorbing ability to silver halide. The scattering of the chemical sensitizing centers can be prevented by carrying out the chemical sensitization in the presence of the compound having the absorbing ability to silver halide and high sensitivity and low fogging can be attained. Though spectral sensitizers to be employed in the invention are described later, preferable examples of the hetero atom-containing compound having the absorbing ability to silver halide are the nitrogen-containing heterocyclic compounds described in Tokkai No. 3-24537.

As the heterocyclic ring in the nitrogen-containing heterocyclic compound, a pyrazole ring, a pyrimidine ring, a 1,2,4-triazole ring, a 1,2,3-triazole ring, a 1,3,4-thiadiazol ring, a 1,2,3-thiadiazole ring, a 1,2,4-thiadiazole ring, a 1,2,5-thiadiazole ring, a 1,2,3,4-tetrazole ring, a pyridazine ring, a 1,2,3-triazine ring and a condensed ring of two or three of the above rings such as a triazlotriazole ring, a diazaindene ring, a triazaindene ring and a pentazaindene ring. A condensed heterocyclic ring of a single heterocyclic ring and an aromatic ring such as a phthalazine ring, a benzimidazole ring, an indazole ring and benzothiazole ring are applicable. Among them, the azaindene ring and an azaindene compound having a hydroxyl group as a substituent such as a hydroxytiazaindene, hydraoxytetrazaindene and hydroxypentazaindene compound are more preferable.

The heterocyclic ring may have a substituent other than the hydroxyl group. As the substituent, for example, an alkyl group, a substituted alkyl group, an alkylthio group, an amino group, a hydroxylamino group, an alkylamino group, a dialkylamino group, an arylamino group, a carboxyl group, an alkoxycarbonyl group, a halogen atom and a cyano group may be applied.

Though the adding amount of the heterocyclic ring is widely varied depending on the size and the composition of the silver halide grain or another condition, the amount is roughly from $1\times10^{-6}$ to 1 mole, and preferably from $1\times10^{-4}$ to $1\times10^{-1}$ moles, per mole of silver.

The silver halide grain may be subjected to the noble metal sensitization using a compound releasing a noble metal ion such as gold ion. For example, chloroaurate and an organic gold compound can be applied as the gold sensitizer.

A reducing sensitization can be applied other than the above-described sensitizing method. As the concrete compound for the reducing sensitization, ascorbic acid, thiourea dioxide, stannous chloride, a hydrazine derivative, a borane compound, a silane compound and a polyamine compound are applicable. The reducing sensitization can be carried out by ripening the emulsion while sustaining the pH at 7 or more or the pAg at 8.3 or less.

The chemically sensitized silver halide relating to the invention may be one prepared in the presence of the organic silver salt, one prepared in no presence of the organic silver salt or a mixture thereof.

The silver halide grain may be subjected to spectral sensitization by absorbing a spectral sensitizing dye. As the spectral sensitizing dye, known spectral sensitizing dyes can be optionally employed. In the invention, the direct transition absorption of silver halide is preferably utilized, in such the case no spectral sensitizer is employed.

When the direct transition absorption of silver halide is not utilized, the silver halide grain is preferably spectrally sensitized by absorbing a spectral sensitizing dye. A cyanine dye, a merocyanine dye, a complex cyanine dye, a complex merocyanine dye, a holopolar cyanine dye, a styryl dye, a hemicyanine dye, an oxonol dye and a hemioxonol dye are applicable. For example, sensitizing dyes described in Tokkai Nos. 63-159841, 60-140335, 63-231437, 63-259651, 63-304242 and 63-15245, and U.S. Pat. Nos. 4,639,414, 4,740,455, 4,741,966, 4,751,175 and 4,835,096 are usable. Useful sensitizing dyes are described in, for example, RD 17643, Item A (p. 23, Dec. 1978), RD 18431, Item X, (p. 437, August 1978) and documents referred therein. The sensitizing dyes having spectral sensitivity suitable for the spectral property of the light source of various laser imagers and scanners are preferably employed. For example, the compounds described in Tokkai Nos. 9-34078, 9-54409 and 9-80679 are preferably employed.

Reducing Agent

In the invention, it is preferable that a compound represented by the following Formula 1 is preferably employed solely or in combination with another reducing agent having a different chemical structure as the reducing agent (silver ion reducing agent). The heat-developable photosensitive material excellent in the high density and the storage ability against light irradiation can be obtained by the use of such the high reactive reducing agents.

Formula 1

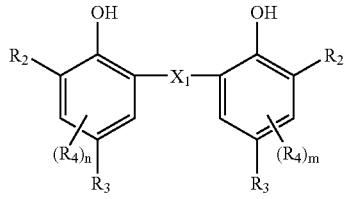

In the formula, $X_1$ is a charcogen atom or a $CHR_1$ group; $R_1$ is a hydrogen atom, an alkyl group, an alkenyl group, an aryl group or a heterocyclic group; $R_2$ is an alkyl group which may be the same or different provided that at least one of them is a secondary or tertiary alkyl group; $R_3$ is a hydrogen atom or a group capable of substituting on the benzene ring; $R_4$ is a group capable of substituting on the benzene ring; and m and n are each an integer of from 0 to 2.

In the invention, it is preferable that the compound represented by Formula 1 is employed together with a compound represented by the following Formula 2 for obtaining the desirable tone.

Formula 2

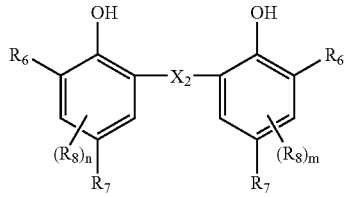

In the formula, $X_2$ is a charcogen atom or a $CHR_5$ group; $R_5$ is a hydrogen atom, a halogen atom, an alkyl group, an alkenyl group, an aryl group or a heterocyclic group; $R_6$ is an alkyl group which may be the same or different provided that at least one of them is a secondary or tertiary alkyl group; $R_7$ is a hydrogen atom or a group capable of substituting on the benzene ring; $R_8$ is a group capable of substituting on the benzene ring; and m and n are each an integer of from 0 to 2.

The using ratio, (weight of the compound of Formula 1): (weight of the compound of Formula 2), is preferably from 5:95 to 45:55, and more preferably from 10:90 to 40:60.

In Formula 1, $X_1$ is a chalcogen atom or a $CHR_1$. The chalcogen atom is sulfur, selenium or tellurium, preferably a sulfur atom. $R_1$ in the $CHR_1$ group is a hydrogen tom, a halogen atom, an alkyl group, an alkenyl group, an aryl group or a heterocyclic group; the halogen atom is a fluorine atom, a chlorine atom or a bromine atom; the alkyl group is preferably a substituted or unsubstituted alkyl group having 1 to 20 carbon atoms. Concrete examples are a methyl group, an ethyl group, a propyl group, a butyl group, a hexyl group, a cyclohexyl group and heptyl group; those of the alkenyl group are a vinyl group, an allyl group, a butenyl group, a hexenyl group, a cyclohexenyl group, hexadienyl group, an ethenyl-2-propenyl group, a 3-butenyl group, a 1-methyl-3-propenyl group, a 3-pentenyl group, a 1-methyl-3-butenyl group; those of an aryl group are a benzene ring and a naphthalene ring; and those of the heterocyclic group are a thiophene group, a furan group, an imidazole group, a pyrazole group and a pyrrole group.

These groups may have a substituent. As the substituent, the substituents of $R_{14}$ of Formula YA are applicable. When there are two or more substituents, they may be the same or different. Particularly preferred substituent is an alkyl group.

$R_2$ is an alkyl groups which may be the same or different provided that at least one of them is a secondary or tertiary alkyl group. A substituted or an unsubstituted alkyl group having from 1 to 20 carbon atoms preferred, for example, a methyl group, an ethyl group, an i-propyl group, a butyl group, an i-butyl group, a t-butyl group, a t-pentyl group, t-octyl group, a cyclohexyl group, a cyclopentyl group, a 1-methylcyclohexyl group and a 1-methylcyclopropyl group.

Though the alkyl group of the substituent is not specifically limited, for example, an aryl group, a hydroxyl group, an alkoxy group, an aryl oxy group, an alkylthio group, an acylamino group, a sulfonamide group, a sulfonyl group, a phosphoryl group, an acyl group, a carbamoyl group, an ester group and a halogen atom are applicable. The substituent may form a saturated ring together with $(R_4)_n$ or $(R_4)_m$. Both of $R_2$s are preferably secondary or tertiary alkyl groups which preferably have from 2 to 20 carbon atoms. The tertiary alkyl group is more preferable and a t-butyl group, a t-pentyl group and 1-methylcyclohexyl group are further preferable, and the t-butyl group is most preferable.

$R_3$ is a hydrogen atom or a group capable of substituting on the benzene ring. Examples of the group capable of substituting on the benzene ring are a halogen atom such as a fluorine atom, a chlorine atom and bromine atom; an alkyl group, an aryl group, a cycloalkyl group, an alkenyl group, a cycloalkenyl group, an alkynyl group, an amino group, an acyl group, an acyloxy group, an acylamino group, a sulfonylamino group, a sulfamoyl group, a carbamoyl group, an alkylthio group, a sulfonyl group, an alkylsulfonyl group, a sulfinyl group, a cyano group and a heterocyclic group.

$R_3$ is preferably a methyl group, an ethyl group, an i-propyl group, a t-butyl group, a cyclohexyl group, a 1-methylcyclohexyl group, and 2-hydroxyethyl group. The methyl group and 20hydroxyethyl group are more preferable.

These groups each may have further a substituent; as such the substituent, those described as the substituent for $R_1$ are applicable. $R_3$ is preferably an alkyl group having from 1 to 20 carbon atoms and a hydroxyl group or its precursor group. An alkyl group having from 1 to 5 carbon atoms is more preferable and 2-hydroxyethyl group is most preferable. The most preferable combination of $R_2$ and $R_3$ is that in which $R_2$ is a tertiary alkyl group such as a t-butyl group and a 1-hydroxy ethyl group, and $R_3$ is a primary alkyl group having a hydroxyl group or its precursor group such as 2-hydroxyethyl group. Plural $R_2$s and $R_3$s may be the same or different.

$R_4$ is a group capable of substituting on the benzene ring; concrete examples of it are an alkyl group having from 1 to 25 carbon atoms such as a methyl group, an ethyl group, a propyl group, an i-propyl group, a t-butyl group, a pentyl group, a hexyl group and a cyclohexyl group; a halogenized alkyl group such as a trifluoromethyl group and perfluorooctyl group; a cycloalkyl group such a cyclohexyl group and cyclopentyl group; an alkylphenyl group such as a propalgyl group; a glycidyl group; an acrylate group an aryl group; an aryl group such as a phenyl group; a heterocyclic group such as a pyridyl group, a thiazolyl group, a oxazolyl group, an imidazolyl group, a furyl group, a pyrrolyl group, a pyrazinyl group, a pyridazinyl group, a selenazolyl group, a sulforanyl group, a piperizinyl group, a pyrazolyl group and a tetrazolyl group; a halogen atom such as a chlorine atom, a bromine atom, an iodine atom and a fluorine atom; an alkoxy group such as a methoxy group, an ethoxy group, a propyloxy group, a pentyloxy group, a cyclopentyloxy group, a hexyloxy group, and a cyclohexyloxy group; an aryloxy group such as a phenoxy group; alkoxycarbonyl group such as a methyloxycarbonyl group, an ethyloxycarbonyl group and a butyloxycarbonyl group; an aryloxycarbonyl group such as a phenyloxycarbonyl group; a sulfonamide group such as a methane sulfonamide group, an ethanesulfonamide group, a butanesulfonamide group, a hexanesulfonamide group, a cyclohexanesulfonamide group and a benzenesulfonamide group; a sulfamoyl group such as an aminosulfonyl group, a methylaminosulfonyl group, a dimethylaminosulfonyl group, a butylaminosulfonyl group, a hexylaminosulfonyl group, a cyclohexylaminosulfonyl group, a phenylaminosulfonyl group, a phenylaminosulfonyl group and a 2-pyridylaminosulfonyl group; a urethane group such as a methylureido group, an ethylureido group, a pentylureido group, a cyclohexylureido group, a phenylureido group and 2-pyridylureido group; an acyl group such as an acetyl group, a propionyl group, a butanoyl group, a hexanoyl group, a cyclohexanoyl group, a benzoyl group and a pyridinoyl group; a carbamoly group such as an aminocarbonyl group, a methylaminocarbamoyl group, a dimethylaminocarbamoyl group, a propylaminocarbamoyl group, a pentylaminocarbonyl group, a cyclohexylaminocarbamoyl group, a phenylaminocarbonyl group and a 2-pyridylaminocarbampyl group; an amido group such as an acetoamido group, a propionamido group, a butanamido group, a hexanamido group and a benzamido group; a sulfonyl group such as a methylsulfonyl group, an ethylsulfonyl group, a butylsulfonyl group, a cyclohexylsulfonyl group, a phenylsulfonyl group and a2-pyridylsulfonyl group; an amino group such as an amino group, an ethylamino group, a dimethylamino group, a butylamino group, a cyclopentylamino group, an anilino group and a 2-pyridylamino group; a cyano group; a nitro group; a sulfo group; a carboxy group; a hydroxyl group; and a oxamoyl group.

These groups may be further substituted with these groups. n and m represent each an integer of from 0 to 2, and most preferably both of them are 0.

$R_4$ may form a saturated ring together with $R_2$ or $R_3$. $R_4$ is preferably a hydrogen atom, a halogen atom or an alkyl group, and more preferably a hydrogen atom. Plural groups represented by $R_4$ may be the same or different.

In Formula 2, $R_5$ is a group the same as $R_1$, and is preferably a cyclic group such as a cyclohexyl group and a cyclohexenyl group. $R_7$ is a group the same as that represented $R_3$, and $R_8$ is a group the same as that represented by $R_4$. $R_6$s are each an alkyl group, and the groups represented by $R_6$ may be the same or different; and they are not a secondary or tertiary alkyl group. The alkyl group is preferably a substituted or unsubstituted group having from 1 to 20 carbon atoms, such as a methyl group, an ethyl group, a propyl group and a butyl group.

Though the substituent of the alkyl group is not specifically limited, for example, an aryl group, a hydroxyl group, an alkoxy group, an aryloxy group, an alkylthio group, an arylthio group, an acylamino group, a sulfonamido group, a sulfonyl group, a phosphoryl group, an acyl group, a carbamoyl group, and ester group and a halogen atom are applicable. The alkyl group may be form a saturated ring together with $(R_8)_n$ or $(R_8)_m$. $R_6$ is preferably a methyl group.

Among the compounds represented by Formula 2, the most preferable compound is a compound satisfying Formula S or Formula T described in European Patent No. 1,278,101, in concrete, Compounds 1-24, 1-28 through 1-54, and 1-56 through 1-75 described on p. 21 through p. 28 of the above document.

Concrete examples of the compounds represented by Formula 1 or Formula 2 are listed below; the invention is not limited thereto.

(1-1)

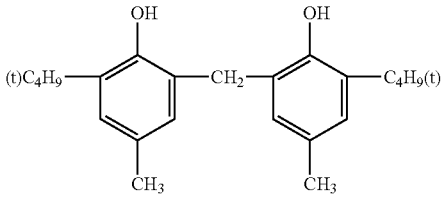

(1-2)

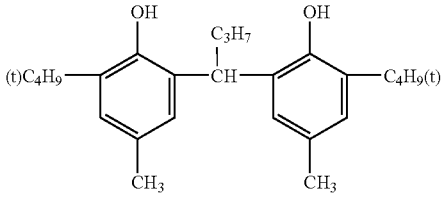

(1-3)

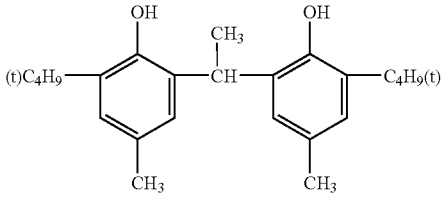

-continued (1-4)

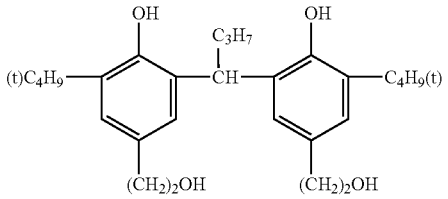

(1-5)

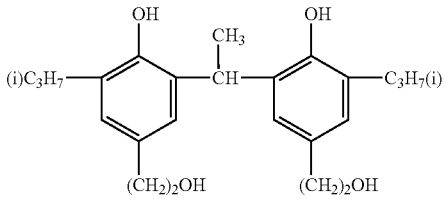

(1-6)

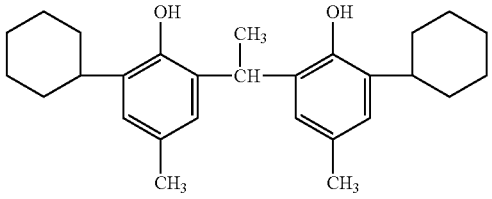

(1-7)

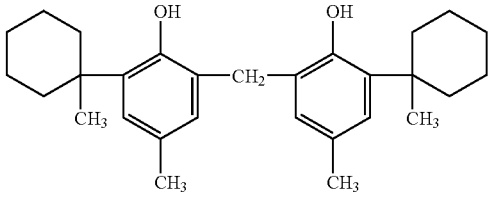

(1-8)

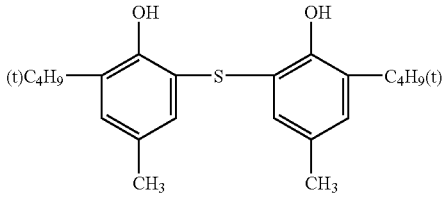

(1-9)

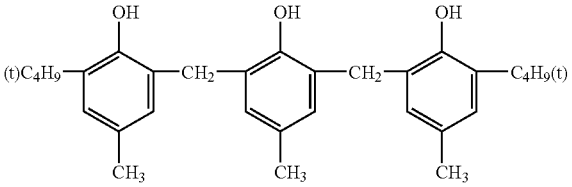

(1-10)

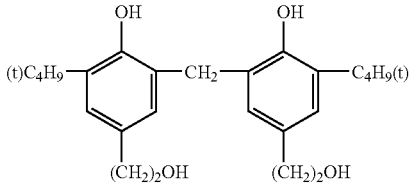

-continued (2-1)

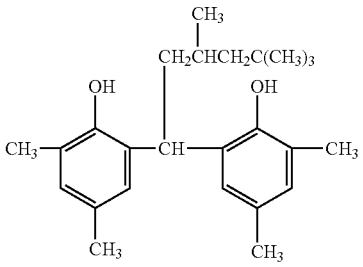

(2-2)

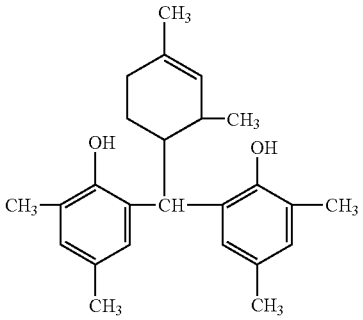

(2-3)

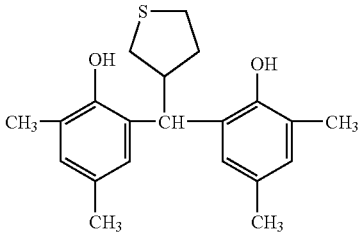

(2-4)

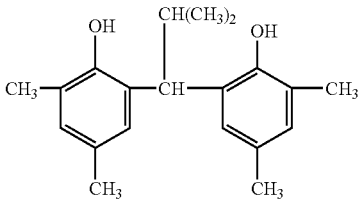

(2-5)

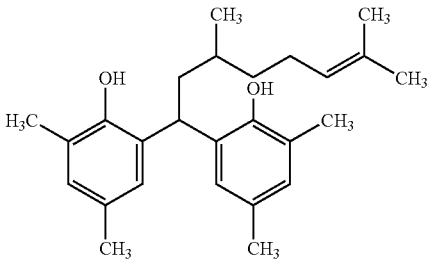

(2-6)

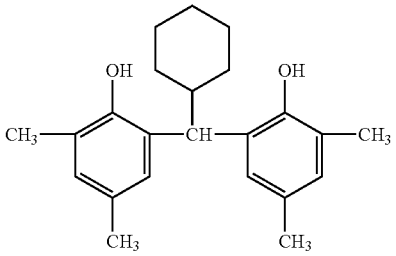

-continued (2-7)

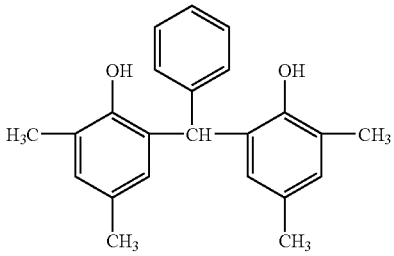

(2-8)

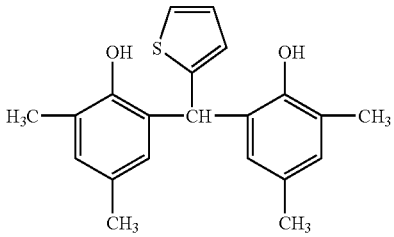

These bisphenol compounds represented by Formula 1 or Formula 2 can be easily synthesized by a known method.

The reducing agent contained in the heat-developable photosensitive material reduces the organic silver salt to form a silver image. Reducing agents capable of being employed together with the reducing agent according to the invention are described in, for example, U.S. Pat. Nos. 3,770,448, 3,773,512 and 3,593,863, RD Nos. 17029 and 29963, and Tokkai Nos. 11-119372 and 2002-62616.

The using amount of the reducing agents including the compound represented by Formula 1 is preferably from $1\times10^{-2}$ to 10 moles, particularly from $1\times10^{-2}$ to 1.5 moles, per mole of silver.

In the heat-developable photosensitive material preferably employed in the invention, a hydrazine derivative, a phenol derivative and a naphthol derivative represented by Formulas 1 through 4 described in Tokkai No. 2003-43614 and Formulas 1 through 3 described in Tokkai No. 2003-66559 are preferably used as the development accelerator together with the foregoing reducing agent.

Toner of Image

The tone of image obtained by the thermal treatment of the heat-developable photosensitive material is described below.

As to the tone of the output image for medical diagnosis such as the usual X-ray film, it is said that more precise diagnosis result can be easily obtained by the reader when the tone of the image is clod tone. The cold tone image is an image having pure black tone or bluish black tone. Besides, the warm tone is said as the brownish black tone. The tone is described below based on the expression system recommended by the International Commission on Illumination (CIE) for more strict quantitative discussion.

The terms of "colder tone" and "warmer tone" regarding the image tone can be represented by hue angle hab between the minimum density $D_{min}$ and the optical density of 1.0. The hue angle hab is calculated by the following expression using the color coordinates a*, b* of the color space L*a*b* having perceptively equal rate which is recommended by the International Commission on illumination (CIE) on 1976.

$$hab=\tan^{-1}(b^*/a^*)$$

As a result of studying by the expression based on the hue angle, it is found that the tone after development of the heat-developable photosensitive material according to the invention has preferably a hue angle hab of within the range of 180°<hab<270°, more preferably 200°<hab<270°, and most preferably 220°<hab<260°. Such the fact is disclosed in Tokkai No. 2002-6463.

Hitherto, it has been known that a diagnosis image having preferable appearance tone can be obtained by controlling u*, v* or a*, b* in the (L*u*v*) color space or the (L*a*b*) color space by CIE 1976 near an optical density 1.0 to a specific value such as described in, for example, Tokkai No. 2001-29164.

However, it is found by the investigation on the heat-developable photosensitive material according to the invention that an image having diagnosis ability higher than that by a usual silver salt photosensitive material can be obtained by controlling a linear regression line into a specific region, the regression line is obtained by plotting u*v* or a*b* at various photographic densities on a graph in which the u* or a* is measured on the horizontal axis and v* or b* is measured on the vertical axis in the (L*u*v*) color space or the (L*a*b*) color space by CIE 1976. The range of preferable conditions is described below.

1. The coefficient of determination (multiple decisions) R2 of the linear regression line is preferably from 0.988 to 1.000; the linear regression line is prepared by plotting the values of u* and v* of silver images having an optical density of 0.5, 1.0, 1.5 and the minimum optical density obtained by the thermal development of the heat-developable photosensitive material on a two-dimensional coordinates in which u* is measured on the horizontal axis and v* is measured on the vertical axis of the color space (L*u*v*) of CIE 1976.

Moreover, it is preferable that the value of v* at the intersecting point of the linear regression line with the vertical axis is from −5 to 5 and the slant of the line (v*/u*) is from 0.7 to 2.5.

2. The coefficient of determination (multiple decisions) R2 of the linear regression line is preferably from 0.988 to 1.000; the linear regression line is prepared by plotting the values of a* and b* of silver images having an optical density of 0.5, 1.0, 1.5 and the minimum optical density obtained by the thermal development of the heat-developable photosensitive material on a two-dimensional coordinates in which a* is measured on the horizontal axis and b* is measured on the vertical axis of the color space (L*a*b*) of CIE 1976.

Moreover, it is preferable that the value of b* at the intersecting point of the linear regression line with the vertical axis is from −5 to 5 and the slant of the line (b*/a*) is from 0.7 to 2.5.

An example of the method for drawing the linear regression line or method for measuring the u*, v* and the a*, b* in the CIE 1076 color space is described below.

A four step wedge sample is prepared including portions each having an optical density of 0.5, 1.0, 1.5 and an unexposed area is prepared. Each of the portions of the wedge sample is measured by a spectral calorimeter such as CM-3600d, manufactured by Minolta Co., Ltd., and u*, v* or a*, b* are calculated. The measurement is carried out employing a F7 light source and a field vision angle of 10° at the transmission measuring mode. The measured values of u*, v* or a*, b* are plotted on a graph in which u* or a* is measured on the horizontal axis and v* or b* is measured on the vertical axis, and then the linear regression line is drawn. The determination coefficient (multiple decisions) R2, the segment and the slant are determined.

A concrete method for obtaining the linear regression line having the above characteristics is described below.

In the invention, the shape of the developed silver can be optimized so as to obtain preferable tone by controlling the adding amount of a compound directly or indirectly concerning to the developing reaction process of the later-mentioned toning agent, the developing agent, the silver halide grain and the aliphatic carboxylic acid silver salt. For example, the tone is leaned toward bluish by making the shape of the developed silver to dendrite shape and is learned to yellowish by making the shape to filament shape. The tone can be controlled by considering such the tendency.

Hitherto, phthaladinone or phthaladine and a phthalic acid or a phthalic anhydride have been usually employed. Examples of useful tone controlling agent are disclosed in RD No. 17029, and U.S. Pat. Nos. 4,123,282, 1,994,732, 3,846,136 and 4,021,249.

In the invention, it is preferable to employ a compound capable of forming a dye image having the maximum absorption within the range of from 360 nm to 700 nm on the occasion of the thermal development. Though a leuco dye or coupler which is colorless before the thermal development is preferably employed form the viewpoint of the freeness of the design and the tone control, a colored dye also can be employed which is capable of forming a dye image having the maximum absorption within the range of from 360 nm to 700 nm by imagewise varying the maximum absorption wavelength on the occasion of thermal development.

The preferably employable leuco dye and coupler are described below.

Cyan Color Forming Leuco Dye

A cyan color forming leuco dye preferably employed in the invention is described below. The leuco dye is preferably a colorless or slightly colored compound which is varied to a colored state by oxidation when the compound is heated at a temperature of about 80° C. to 200° C. for a time of from 0.5 to 30 seconds, and any leuco dyes capable of forming a dye by oxidation by silver ion can be employed. A pH sensitive compound capable of being oxidized to a colored state is useful.

In the invention, the cyan color forming leuco dye particularly preferably employed is a color image forming agent which is increased in the light absorption by oxidation within the range of from 600 to 700 nm, which is described in Tokkai No. 59-206831 (particular compounds having a within the range of from 600 to 700 nm), 5-204087 (compounds of Formulas I through IV, in concrete Compounds 1 through 18 in paragraphs 0032 to 0037) and 11-231460 (Compounds of Formulas 4 through 7, in concrete, Compounds No. 1 to No. 79 described in paragraph 105).

The cyan color forming leuco dye particularly preferably employed in the invention is represented by the following Formula CL.

Formula CL

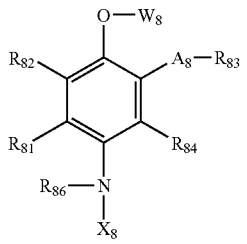

In the formula, $R_{81}$ and $R_{82}$ are each a hydrogen atom, a halogen atom, a substituted or unsubstituted alkyl group, alkenyl group, alkoxyl group or an —NHCO—$R_{10}$ group in which $R_{10}$ is an alkyl group, an aryl group a heterocyclic group, or each a group capable of forming an aliphatic hydrocarbon ring, an aromatic hydrocarbon ring or a heterocyclic ring by linking with together. $A_8$ is an —NHCO— group, an —CONH— group or an —NHCONH— group; and $R_{83}$ is a substituted or unsubstituted alkyl group, aryl group or heterocyclic group. Moreover, the -$A_8$-$R_{83}$ group may be a hydrogen atom. $W_8$ is a hydrogen atom, a —CONH—$R_{58}$ group, a —CO—$R_{85}$ group or a —CO—O—$R_{85}$ group, in which $R_{85}$ is a substituted or unsubstituted alkyl group, aryl group or heterocyclic group; and $R_{84}$ is a hydrogen atom, a halogen atom or a substituted or unsubstituted alkyl group, alkenyl group, alkoxy group, carbamoyl group or nitrile group. $R_{86}$ is a —CONH—$R_{87}$ group, a —CO—$R_{87}$ or a —CO—O—$R_{87}$ group, in which $R_{87}$ is a substituted or unsubstituted alkyl group, aryl group or heterocyclic group. $X_8$ is a substituted or unsubstituted aryl or heterocyclic group.

In Formula CL, the atom or group represented by $R_{81}$ or $R_{82}$ is a halogen atom such as a fluorine atom, a bromine atom and a chlorine atom; an alkyl group having 20 or less carbon atoms such as a methyl group, an ethyl group, a butyl group and a dodecyl group; an alkenyl group having 20 or less carbon atoms such as a vinyl group, an allyl group, a butenyl group, a hexenyl group, a hexadienyl group, an ethenyl-2-propenyl group, a 3-butenyl group, 1-methyl-3-propenyl group, a 3-pentenyl group and a 1-methyl-3-butenyl group; or an alkoxy having 20 or less carbon atoms such as a methoxy group and an ethoxy group. The alkyl group represented by $R_{10}$ in the —NHCO—$R_{10}$ group is an alkyl group having 20 or less carbon atoms such as a methyl group, an ethyl group, a butyl group and a dodecyl group; an aryl group having from 6 to 20 carbon atoms such as a phenyl group and a naphthyl group; and a heterocyclic group such as a thiophene group, a furan group, n imidazole group, a pyrazole group and a pyrrole group. The alkyl group represented by $R_{83}$ is an alkyl group having 20 or less carbon atoms such as a methyl group, an ethyl group, a butyl group and a dodecyl group, and the aryl group is an aryl group having from 6 to 20 carbon atoms such as a phenyl group and naphthyl group; and the heterocyclic group is, for example, a thiophene group, a furan group, an imidazole group, a pyrazole group or a pyrrole group. In the —CONH—$R_{85}$, —OCO—$R_{85}$ or —CO—O—$R_{85}$, the alkyl group represented by $R_{85}$ is preferably an alkyl group having 20 or less carbon atoms such as a methyl group, an ethyl group, a butyl group and a dodecyl group; the aryl group is preferably an aryl group having from 6 to 20 carbon atoms such as a phenyl group and a naphthyl group; and the heterocyclic group is a heterocyclic group such as a thiophene group, a furan group, an imidazole group, a pyrazole group and a pyrrole group.

The halogen atom represented by $R_{84}$ is a halogen atom such as a fluorine atom, a chlorine atom, a bromine atom and an iodine atom; such the alkyl group is a chain or cyclic alkyl group such as a methyl group, a butyl group, a dodecyl group and a cyclohexyl group; such the alkenyl group is an alkenyl group having 20 or less carbon atoms such as a vinyl group, an aryl group, a butenyl group, a hexenyl group, a hexadienyl group, an ethenyl-2-propenyl group, a 3-butenyl group, a 1-methyl-3-propenyl group, a 3-pentenyl and a 1-methyl-3-butenyl group; the alkoxy is a alkoxy group such as a methoxy group, a butoxy group and a tetradecyloxy group; the carbamoyl group such as a diethylcarbamoyl group and a phenyl carbamoyl group and a nitrile group are also applicable. Among them, the hydrogen atom and the alkyl group are preferred. $R_{83}$ and $R_{84}$ may form a ring structure by linking with together.

The foregoing groups each may have one or more substituents. Examples of typical substituent include a halogen atom such as a fluorine atom, a chlorine atom and a bromine atom; an alkyl group such as a methyl group, an ethyl group, a propyl group, a butyl group and a dodecyl group; a hydroxyl group; a cyano group; a nitro group; an alkoxy group such as a methoxy group and an ethoxy group; an alkylsulfonamidogroup such as a methylsulfonamido group and octylsulfonamido group; an arylsulfonamido group such as a phenylsulfonamido group and a naphthylsulfonamido group; an alkylsulfamoyl group such as a butylsulfamoyl group; an arylsulfamoyl group such as a phenylsulfamoyl group; an alkyloxycarbonyl group such as a methoxycarbonyl group; an aryloxycarbonyl group such as a phenyloxycarbonyl group; an aminosulfonamido group; an acylamino group; a carbamoyl group; a sulfonyl group; a sulfinyl group; a sulfoxy group; a sulfo group; an aryloxy group; an alkylcarbonyl group; an arylarbonyl group; and an aminocarbonyl group.

$R_{10}$ and $R_{85}$ are each preferably a phenyl group, and more preferably a phenyl group having a plurality of halogen atom or cyano group as the substituents.

In the —CONH—$R_{87}$ group, —CO—$R_{87}$ group or —CO—O—$R_{87}$ group, $R_{87}$ is an alkyl group, preferably an alkyl group having 20 or less carbon atoms such as a methyl group, an ethyl group, a butyl group or a dodecyl group; an aryl group preferably an aryl group having from 6 to 20 carbon atoms such as a phenyl group, a naphthyl group and a thienyl group; a heterocyclic group such as a thiophene group, a furan group, an imidazole group, a pyrazole group and a pyrrole group.

The group represented by $R_{87}$ may have a substituent the same as that cited in the description of $R_{81}$ through $R_{84}$ of Formula CL.

The aryl group represented by $X_8$ is an aryl group having from 6 to 20 carbon atoms such as a phenyl group, a naphthyl group and a thienyl group; and the heterocyclic group is one such as a thiophene group, a furan group, an imidazole group, a pyrazole group and a pyrrole group.

The group represented by $X_8$ may have a substituent the same as that cited in the description of $R_{81}$ through $R_{84}$ of Formula CL.

The group represented by $X_8$ is preferably the aryl group or the heterocyclic group having an alkylamino group such as a diethylamino group at the para-site.

These groups may contain a photographically useful group.

Though concrete examples of the cyan color forming leuco dye are shown below, the cyan color forming leuco dye usable in the invention is not limited thereto.

(CA-1)
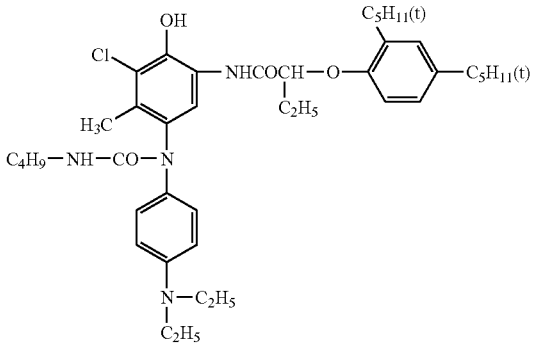
(CA-2)
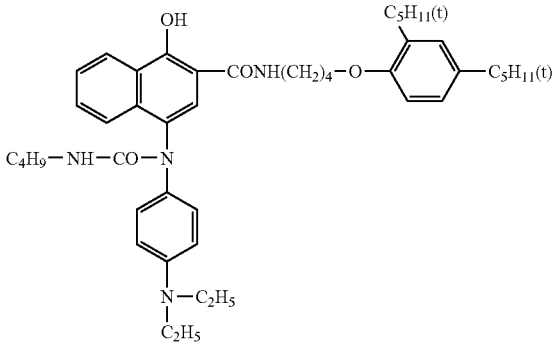
(CA-3)
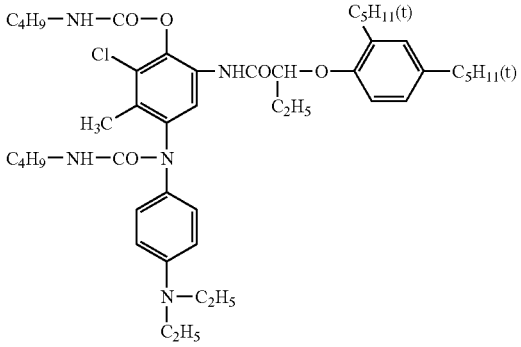
(CA-4)
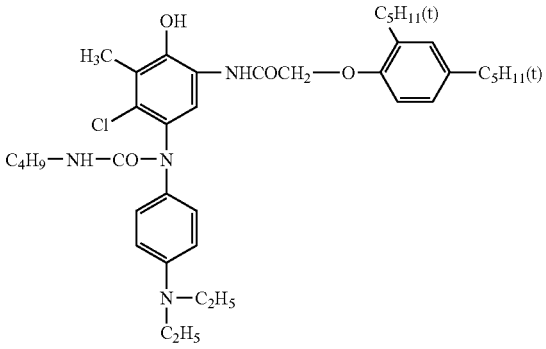
-continued
(CA-5)
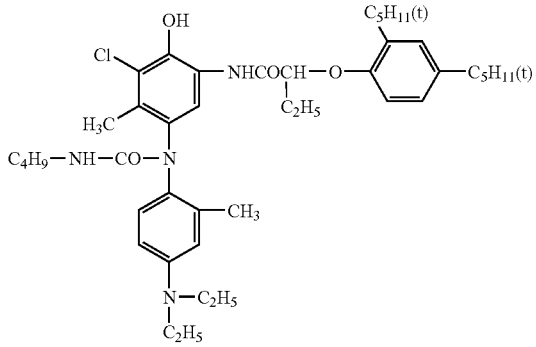
(CA-6)
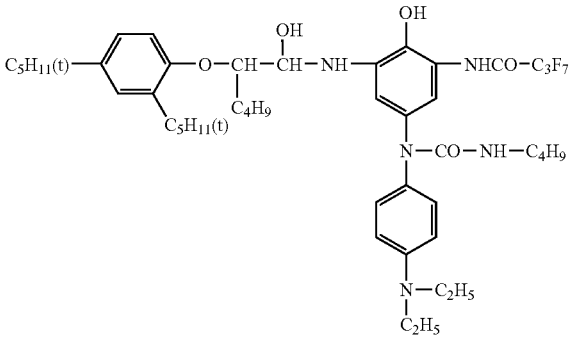
(CA-7)
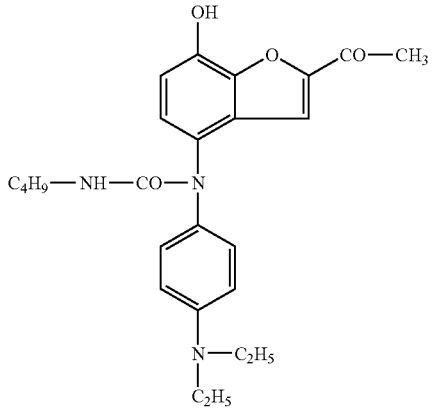
(CA-8)
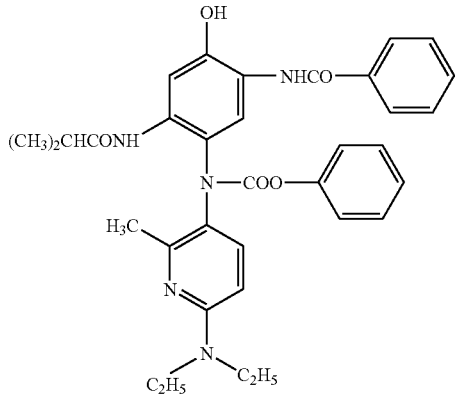

-continued (CA-9)

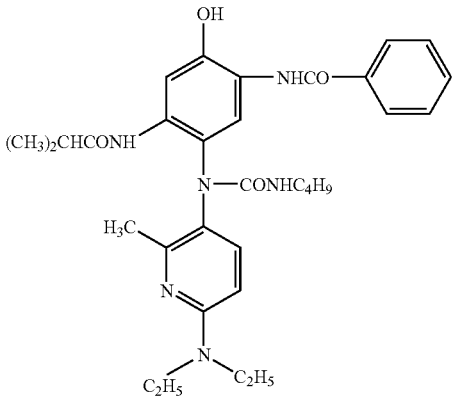

(CA-10)

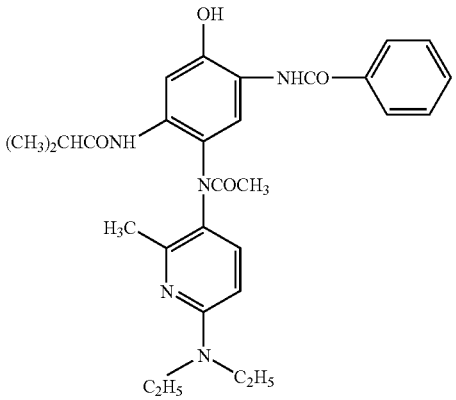

(CA-11)

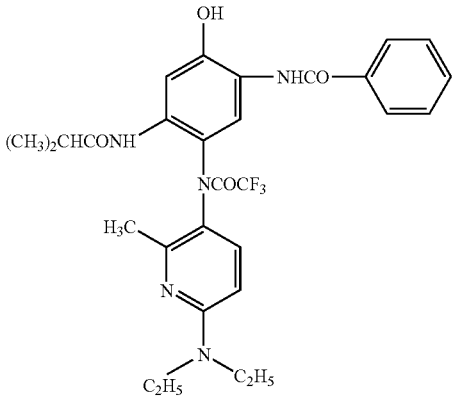

(CA-12)

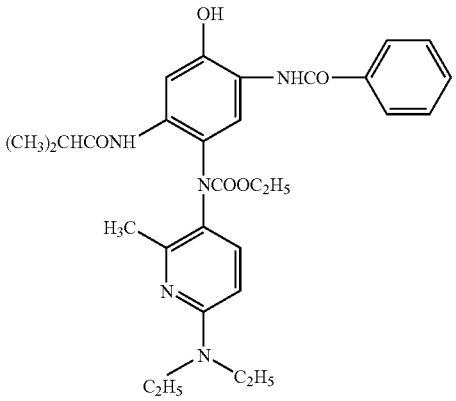

The adding amount of the cyan color forming dye is usually from 0.00001 to 0.05 moles per mole of silver, preferably from 0.0005 to 0.02 moles per mole of silver, and more preferably from 0.001 to 0.01 moles per mole of silver. The adding amount ratio of the cyan color forming leuco dye to the sum of the reducing agent represented by Formula 1 and that represented by Formula 2 is preferably from 0.001 to 0.2, and more preferably from 0.005 to 0.1, in mole ratio. In the invention, it is preferable to form the color so that the sum of the maximum density at the maximum absorption wavelength of the color image formed by the cyan color forming leuco dye is from 0.01 to 0.50, more preferably from 0.02 to 0.30, and particularly preferably from 0.03 to 0.10.

In the invention, the tone can be more finely controlled by adding a magenta color forming leuco dye or a yellow color forming leuco dye additionally to the cyan color forming leuco dye.

Yellow color forming leuco dye

In the invention, the yellow color forming leuco dye can be added additionally to the cyan color forming leuco dye and the magenta color forming leuco dye for finely controlling the tone. A color image forming agent capable of being increased the light absorbance within the range of from 360 to 480 nm by oxidation is preferably as the yellow color forming dye. Compounds represented by Formula YA and those represented by Formula YL are preferably employed.

Formula YA

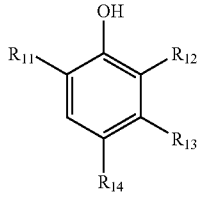

In the formula, $R_{11}$ is a substituted or unsubstituted alkyl group and $R_{12}$ is a hydrogen atom or a substituted or unsubstituted alkyl group or an acylamino group, provided that $R_{11}$, and $R_{12}$ are not 2-hydroxyphenylmethyl group. $R_{13}$ is a hydrogen atom or a substituted or unsubstituted alkyl group and $R_{14}$ is a substituent capable of substituting on the benzene ring.

Formula YA is described in detail below.

The alkyl group in Formula YA is preferably an alkyl group having from 1 to 30 carbon atoms which may have a substituent.

In concrete, a methyl group, an ethyl group, a butyl group, an octyl group, an i-propyl group, a t-butyl group, a t-octyl group, a t-pentyl group, a sec-butyl group, a cyclohexyl group and a 1-methyl-cyclohexyl group are preferable, and a group sterically larger than i-propyl group such as an i-propyl group, an i-nonyl group, a t-butyl group, a t-amyl group, a t-octyl group, a cyclohexyl group, a 1-methylcyclohexyl group and an adamantly group are preferable, among them a secondary and tertiary alkyl groups are preferred. The tertiary alkyl groups such as a t-butyl group and a t-pentyl group are particularly preferred. Examples of the group capable of being the substituent of $R_{11}$ are a halogen atom, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group and a phosphoryl group.

$R_{12}$ is a hydrogen atom, a substituted or unsubstituted alkyl group or an acylamino group. The alkyl group represented by $R_{12}$ is preferably an alkyl group having from 1 to 30 carbon atoms; and the acylamino group is preferably an acylamino group having from 1 to 30 carbon atoms. Description on the alkyl group is the same as that on the forgoing $R_{11}$.

The acylamino group represented by $R_{12}$ may be unsubstituted or substituted, in concrete, an acetylamino group, an alkoxyacetylamino group and an aryloxyacetylamino group are cited. $R_{12}$ is preferably a hydrogen atom or an unsubstituted alkyl group having from 1 to 24 carbon atoms such as a methyl group, an i-propyl group and t-butyl group. $R_{11}$ and $R_{12}$ are not 2-hydroxymethyl group.

$R_{13}$ is a hydrogen atom or a substituted or unsubstituted alkyl group. The alkyl group is preferably an alkyl group having from 1 to 30 carbon atoms, description on the alkyl group is the same as that on $R_{11}$. $R_{13}$ is preferably a hydrogen atom or an alkyl group having from 1 to 24 such as a methyl group, a t-propyl group and a t-butyl group. One of $R_{12}$ and $R_{13}$ is preferably a hydrogen atom.

$R_{14}$ is a group capable of substituting on the benzene ring, for example, a halogen atom such as a fluorine atom, a chlorine atom and a bromine atom; an alkyl group such as a methyl group, an ethyl group, a propyl group, a butyl group, a pentyl group, an i-pentyl group, a 2-ethylhexyl group, an octyl group and a decyl group; a cycloalkyl group such as a cyclohexyl group and a cycloheptyl group; an alkenyl group such as an ethenyl-2-propenyl group, a 3-butenyl group, a 1-methyl-3-propenyl group, a 3-pentenyl group and a 1-methyl-3-butenyl group; a cycloalkenyl group such as a 1-cycloalkenyl group and a 2 cycloalkenyl group; an alkynyl group such as an ethynyl group and 1-propinyl group; an alkoxy group such as a methoxy group, an ethoxy group and a propoxy group; an alkylcarbonyloxy group such as an acetyloxy group; an alkylthio group such as a methylthio group and a trifluoromethylthio group; a carboxyl group; an alkylcarbonylamino group such as an acetylamino group; a ureido group such as a methylaminocarbonylamino group; an alkylsulfonylamino group such as a methanesuofonylamino group; an alkylsulfonyl group such as a methanesulfonyl group and trifluoromethanesulfonyl group; a carbamoyl group such as a carbamoyl group, an N,N-dimethylcarbamoyl group and an N-morpholinocarbonyl group; a sulfamoyl group such as a sulfamoyl group, an N,N-dimethylsulfamoyl group and a morpholinosulfamoyl group; a trifluoromethyl group; a hydroxyl group; a nitro group; a cyano group; an alkylsulphonamido group such as a methanesulfonamido group and a butanesulfonamido group; an alkylamino group such as an amino group, and an N,N-diethylamino group; a sulfo group; a phosphono group; a sulfite group; a sulfino group; an alkylsulfonylaminocarbonyl group such as a methanesulfonylaminocarbonyl group and an ethanesulfonylaminocarbonyl group; an alkylcarbonylaminosulfonyl group such as an acetoamidosulfonyl group and a methoxyacetoamidosulfonyl group; an alkynylaminocarbonyl group such as acetoamidocarbonyl group and a methoxyacetoamidocarbonyl group; or an alkylsulfinylaminocarbonyl group such as a methanesulfinylaminocarbonyl group and an ethanesulfinylaminocarbonyl group. $R_{14}$ is preferably a substituted or unsubstituted alkyl group having from 1 to 30 carbon atoms and an oxycarbonyl group having from 2 to 30 carbon atoms, and an alkyl group having from 1 to 24 carbon atoms is more preferable. As the substituent of the alkyl group, an aryl group, an amino group, an alkoxy group, an oxycarbonyl group, an imido group and an ureido group are applicable. The aryl group, amino group, oxycarbonyl group and alkoxy group are more preferable. These alkyl groups may be substituted by these groups.

Among the compounds represented by Formula YA, bisphenol compounds represented by Formula YB are described below, which are particularly preferably employed in the invention.

Formula BY

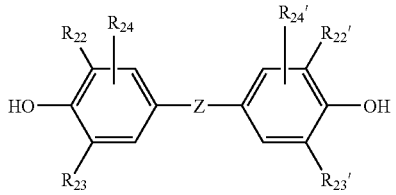

In the formula, Z is an —S— atom, or a —C($R_{21}$) ($R_{21'}$)— group, and $R_{21}$ and $R_{21'}$ are each a hydrogen atom or a substituent. The substituent represented by $R_{21}$ and $R_{21'}$ is, for example, the substituent of $R_{14}$ of Formula YA. $R_{21}$ and $R_{21}$, are preferably a hydrogen atom or an alkyl group.

$R_{22}$, $R_{23}$, $R_{22'}$ and $R_{23'}$ are each a substituent. As the substituent, groups the same as the substituents represented by $R_{21}$ and $R_{21'}$ are applicable.

$R_{22}$, $R_{23}$, $R_{22'}$ and $R_{23'}$ are preferably an alkyl group, an alkenyl group, an alkynyl group, an aryl group or a heterocyclic group, and the alkyl group is more preferable. For the substituent on the alkyl group, the substituents the same as those described as to the substituent represented by $R_{21}$ and $R_{21'}$.

$R_{22}$, $R_{23}$, $R_{22}$ , and $R_{23'}$ are preferably a tertiary alkyl group such as a t-butyl group, a t-pentyl group, a t-octyl group and a 1-methyl-cyclohexyl group.

$R_{24}$ and $R_{24'}$ are each a hydrogen atom or a substituent. As the substituent, groups the same as those represented by $R_{21}$ and $R_{21'}$ are applicable.

Examples of compound represented by Formula YA or YB include Compounds II-1 through II-40 described in Tokkai No. 2002-169249, paragraph 0032 to 0038, and Compounds ITS-1 through ITS-12 described in EP No. 1,211,093, paragraph 0062.

Concrete examples of the bisphenol compound represented Formula YA or YB are shown below; the invention is not limited thereto.

(YA-1)

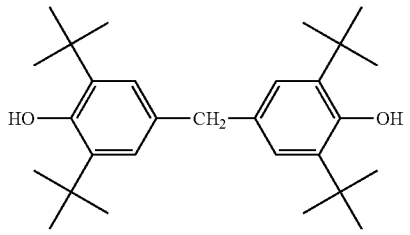

-continued
(YA-2)
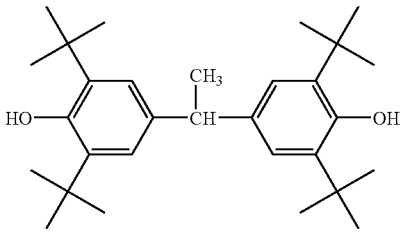
(YA-3)
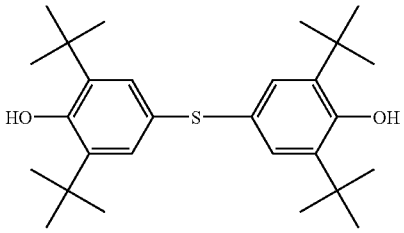
(YA-4)
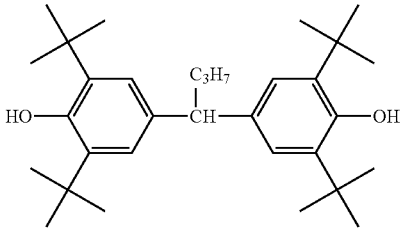
(YA-5)
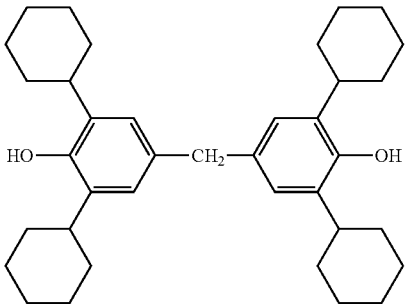
(YA-6)
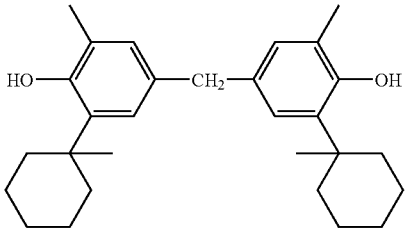
(YA-7)
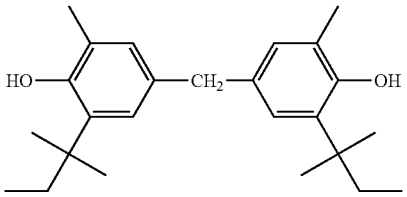
-continued
(YA-8)
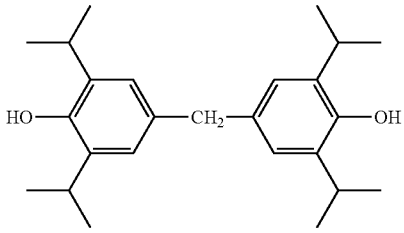
(YA-9)
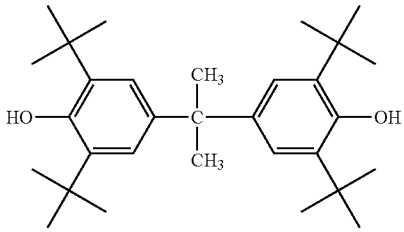
(YA-10)
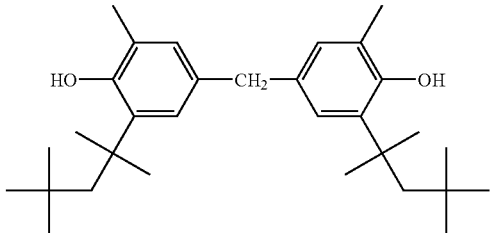
(YA-11)
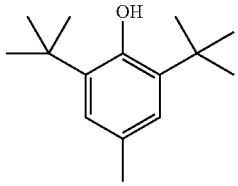
(YA-12)
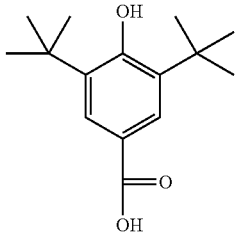
(YA-13)
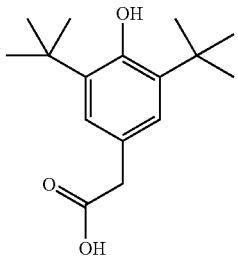

-continued (YA-14)

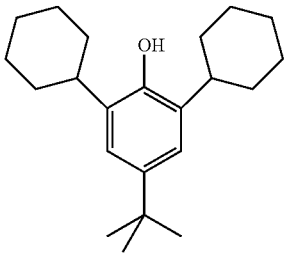

(YA-15)

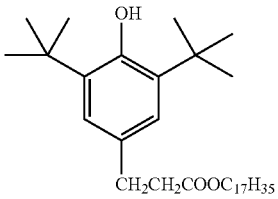

The adding amount of the compound of Formula YA, including a hindered phenol compound and the compound of Formula YB is usually from 0.00001 to 0.01 moles, preferably from 0.005 to 0.01 moles, and more preferably from 0.001 to 0.008 moles, per mole of silver. The adding amount ratio of the compound of Formula YA, including a hindered phenol compound and the compound of Formula YB, to the sum of the reducing agents represented by Formula 1 and Formula 2 is preferably from 0.001 to 0.2, and more preferably from 0.005 to 0.1, in mole ratio.

In the invention, it is preferable to form the color so that the sum of the maximum density at the maximum absorption wavelength of the color image formed by the yellow color forming leuco dye is from 0.01 to 0.50, more preferably from 0.01 to 0.30, and particularly preferably from 0.02 to 0.10.

There is no limitation to typical leuco dye suitable for using in the invention additionally to the yellow color forming leuco dye. For example, a biphenol leuco dye, a phenol leuco dye, an indoaniline leuco dye, an acrylized azine leuco dye a phenoxazine leuco dye, a phenodiazine leuco dye and phenothiazine leuco dye are employable. Useful leuco dyes are disclosed in U.S. Pat. Nos. 3,445,234, 3,846,136, 3,994,732, 4,021,249, 4,021,250, 4,022,617, 4,123,282, 4,368,247 and 4,461,681, and Tokkai. Nos. 50-36110, 59-206831, 5-204087, 11-231460, 2002-169249 and 2002-236334.

In the invention, it is preferable that cyan color forming leuco dye is used together with the yellow color forming leuco dye for preventing the variation (particularly yellowing) of the tone accompanied with the use of the highly active reducing agent and excessively reddish coloring of the image at the high density portion of not less than 2.0 caused by the use of fine particle of silver halide.

Binder

The binder suitable for the heat-developable photosensitive material is one transparent or semitransparent and usually colorless film forming material such as natural polymer, synthesized polymer and copolymer and, for example, that described in Tokkai No. 2001-330918, paragraph 0069. Among them, the binder preferable for the heat-developable photosensitive material according to the invention is a polyvinyl acetal, and poly(vinyl butyral) is particularly preferable. Such the polymers are described in detail below.

A cellulose ester having higher softening point such as triacetyl cellulose and cellulose acetate-butylate is preferable for an over coat layer and a subbing layer, particularly for non-photosensitive layer such as an protective layer and a back-coat layer. The binder may be used in combination of two or more kinds thereof according to necessity.

It is preferable to introduce at least one polar group selected from the group consisting of a —COOH group, an —$SO_3M$ group, an —$OSO_3M$ group, a —P═O$(OM)_2$ group, an —O—P═O$(OM)_2$ group, an —N$(R)_2$ group, an —$N^+(R)_3$ group (M is an alkali metal base and R is an hydrocarbon group) an epoxy group, an —SH group and a —CN group to the binder by copolymerization or addition reaction, and the —$SO_3M$ group and the —$OSO_3M$ group are preferable. The amount of such the polar group is from $1\times10^{-1}$ to $1\times10^{-8}$ moles/g and preferably from $1\times10^{-2}$ to $1\times10^{-6}$ moles/g.

Such the binder is employed in a range in which it effectively functions as binder. The effective range can be easily decided by one skilled in the field of the art. For example, when the organic silver salt is contained in the image forming layer, the ratio of the binder to the organic silver salt is preferably from 15:1 to 1:2 and particularly preferably from 8:1 to 1:1 by weight. Namely, the amount of the binder in the image forming layer is preferably from 1.5 to 6 g/$m^2$ and more preferably from 1.7 to 5 g/$m^2$. When the amount is less than 1.5 g/$m^2$, the density at the unexposed area is largely increase so that the photosensitive material is made unacceptable for practical use in some cases.

The glass transition point Tg of the binder to be employed in the invention is preferably from 70 to 105° C. The Tg can be determined by a differential calorimeter, and is defined by the crossing point of the base line and the slant line of the endothermic peak. In the invention, the Tg is determined according to the method described in Brandrap et al. "Polymer Handbook" III-139 to 179 page (1966, Weily and son Co., Ltd.).

When the binder is copolymer, the Tg is calculated by the following expression.

$$Tg\ (\text{copolymer})\ (^\circ\ C.)=v_1Tg_1+v_2Tg_2+\ldots+v_nTg_n$$

In the above expression, $v_1$, $v_2$ . . . $v_n$ each represents the weight ratio of each of the monomers in the copolymer, and $Tg_1$, $Tg_2$ . . . $Tg_n$ each represent the Tg (° C.) of monomer derived from each of the monomers. The accuracy of the Tg calculated according to the above expression is ±5° C.

When the binder having a Tg of from 70 to 105° C. is employed, the sufficient maximum density can be obtained in the image formation.

The binder relating to the invention has a Tg of from 70 to 105° C., and a number average molecular weight of from 1,000 to 1,000,000 and preferably from 10,000 to 500,000, a polymerization degree of approximately from 50 to 1,000. Examples of polymer and copolymer containing an ethylenic unsaturated monomer are those described in Tokkai No. 2001-330918, paragraph 0069.

Among them, particularly preferred examples include alkyl acrylates, aryl methacrylates and styrenes. Among such the polymer compounds, a polymer compounds each having an acetal group are preferable. Polyvinyl acetal having an acetoacetal structure is more preferable in the polymer having the acetal group. Examples of the polyvinyl acetal are described in U.S. Pat. Nos. 1,358,826, 3,003,879, and 2,828,204, and British Patent No. 771,155.

Polymer compounds having the acetal group represented by Formula V described in Tokkai No. 2002-287299, paragraph 150 are particularly preferred.

As polyurethane resin capable of being employed in the invention, known ones having a structure such as polyester-polyurethane, polyether-polyurethane, polyether-polyester-polyurethane, polycarbonate-polyurethane, polyester-polycarbonate-polyurethane and polycaprolatone-polyurethane are employable. Such the polymers each preferably has at least one hydroxyl group on each of the terminal of the urethane molecule so as to be two or more hydroxyl groups in total. It is preferable that many hydroxyl groups are contained in the molecule since the hydroxyl groups forms a three dimensional net work structure by linking with polyisocyanate as a hardening agent. It is preferable that the hydroxyl group is situated at the terminal of the molecule since the hydroxyl group situated at the terminal shows high reactivity with the hardening agent. The polyurethane having three or more hydroxyl groups is preferable and that having four or more hydroxyl groups is more preferable. When the polyurethane is employed in the invention, it is preferable that the polyurethane has a Tg of from 70 to 105° C., a breaking elongation of from 100 to 2000% and a breaking stress of from 0.5 to 100 $N/mm^2$.

These polymer compounds may be employed singly of in combination of two or more kinds thereof.

In the image forming layer relating to the invention, the foregoing binder is employed as a principal binder. The principal binder is a binder accounting for not less than 50% by weight of the whole binder in the image forming layer. Therefore, it is allowed to employ another resin within the range of less than 50% by weight. Such the resin is not specifically limited as long as the resin is miscible with the foregoing resin preferably employed in the invention. Polyvinyl resin, polyacryl resin and urethane resin are preferably usable.

A gelling agent may be added to the image forming layer. The gelling agent is a compound capable of giving a yield point to the system and disappearing or decreasing the fluidity of the system.

It is a preferable embodiment that the image forming layer coating liquid contains water-soluble polymer latex. In such the case, it is preferable that the polymer latex dispersed in aqueous medium accounts for 50% or more of the entire binder in the image forming layer. When the image forming layer contains the polymer latex, the content of the polymer latex is preferably not less than 50% by weight, and more preferably not less than 70% by weight, of the entire binder in the image forming layer.

The polymer latex is a dispersion comprising fine particles of water-insoluble hydrophobic polymer dispersed in an aqueous dispersing medium. Any dispersing states such as one in which the polymer is emulsified in the dispersing medium, one produced by emulsion polymerization, one dispersed by micelle dispersion, and one in which the polymer partially has a hydrophilic structure and the molecule chain is dispersed itself in a molecule state may be applied. The average diameter of the dispersed particles is preferably from 1 to 50,000 nm and more preferably from 5 to 1,000 nm. There is no limitation of the particle diameter distribution of the dispersed particles, and both of one having wide particle diameter distribution and one having monodispersed distribution are applicable.

Latex so-called core/shell type latex is may be employed other than the usual latex having a uniform structure is also preferably employed in the invention. In such the case, preferable result can be obtained sometimes by making difference between the Tg of the core and that of the shell. The minimum film forming temperature (MFT) is preferably from −30 to 90° C. and more preferably about from 0 to 70° C. A film forming aid may be added for controlling the minimum film forming temperature.

The film forming aid is also called as plasticizer and is a compound (usually a solvent) capable of lowering the minimum film forming temperature of the polymer latex, which is described, for example, in S. Muroi, "Gousei Latex Kagaku (Chemistry of Synthesized Latex)" Koubunshi Kankoukai, 1970.

The kinds of polymer to be employed in the polymer latex include acryl resin, vinyl acetate resin, polyester resin, polyurethane resin, rubber type resin, vinyl chloride resin, vinylidene chloride resin, polyolefin resin and copolymer thereof. The polymer may be chain polymer, branched polymer and crosslinked polymer. The polymer either may be a homopolymer formed by polymerization of a single kind of monomer or a copolymer formed by two or more kinds of monomer. The copolymer may be a random polymer or a block polymer. The molecular weight of the polymer is usually from 5,000 to 1,000,000 and preferably about from 10,000 to 100,000. When the molecular weight of the polymer is too low, the mechanical strength is insufficient and when the molecular weight is too high, film forming property is degraded so that both of such the polymers are not preferable.

The polymer latex preferably has an equilibrium moisture content of from 0.01 to 2% and more preferably from 0.01 to 1% by weight at a temperature of 25° C. and a relative humidity (RH) of 60%. As to the method for measuring the equilibrium moisture, for example, "Koubunshi Kougaku Kouza 14, Koubunshi Zairyou Shiken Hou (Polymer Engineering Science Course 14, Material Testing Method)", edit. by Koubunshi Gakkai, Chijin Shokan, can be referred.

Concrete examples of the latex are described in Tokkai No. 2002-287299. These polymers may be employed singly or in a blended state of two or more kinds. As the kind of the polymer of the polymer latex, one containing a carboxylic acid component such as acrylate or methacrylate in an amount of from about 0.1 to 10% by weight is preferred.

A hydrophilic polymer such as gelatin, poly(vinyl alcohol), methyl cellulose, hydroxypropyl cellulose, carboxymethyl cellulose and hydroxypropylmethyl cellulose may be added according to necessity within a range of mot more than 50% by weight of the entire amount of the polymer. The adding amount of the hydrophilic polymer is preferably not more than 30% by weight of the entire amount of the binder in the photosensitive layer.

Regarding the adding order of the organic silver salt and the water-soluble polymer latex in the course of the preparation of the coating liquid of the image forming layer, though any of them may be firstly added and also may be simultaneously added, preferably the polymer latex is added later.

It is preferable that the organic silver salt and the reducing agent are added before the polymer latex. When the liquid is stood after the mixing of the organic silver salt and the polymer latex, excessively low standing temperature causes degradation in the surface state of the coated layer, excessively high temperature causes increasing in the fogging. Consequently, the coating liquid is preferably stood at a temperature of from 30 to 65° C., more preferably from 35 to 60° C., and further preferably from 35 to 55° C., for the following time. Such the temperature can be held by retaining warmth of the liquid preparation vessel.

For coating the image forming layer coating liquid, the liquid is preferably employed after standing for a time of from 30 minutes to 24 hours, more preferably from 60 minutes to 12 hours, and further preferably from 120 minutes to 10 hours.

The term of "after mixing" means a time after the addition of the organic silver salt and the water-soluble polymer latex and the uniform dispersion of the added materials.

It has been known that the adhesiveness of the coated layer is improved and the unevenness of development is inhibited by adding the crosslinking agent. The crosslinking agent is further effective for inhibiting fogging during storage and the formation of print-out silver after the development. Various kinds of crosslinking agent usually employed for photographic photosensitive material such as aldehyde type, epoxy type, ethyleneimine type, vinylsulfon type, sulfonate type, acryloyl type, carbodiimide type, and silane compound type crosslinking agent described in Tokkai No. 50-96216 are employable. The following isocyanate type, silane compound type, epoxy type and acid anhydride are preferable.

The isocyanate crosslinking agent is an isocyanate compound having at least two isocyanate groups and an adduct thereof; concrete examples thereof include an aliphatic diisocyanate, an aliphatic diisocyanate having a cyclic group, a benzenediisocyanate, a naphthalenediisocyanate, a biphenyldiisocyanate, a diphenylmethanediisocyanate, a triphenylmethanediisocyanate, a triisocyanate, a tetraisocyanate, an adduct of these isocyanate compounds and an adduct of the isocyanate with a di-valent or tri-valent alcohol. As concrete examples, the isocyanate compounds described in Tokkai No. 56-5535, p. 10 to 12 are applicable.

The adduct of the isocyanate compound with the polyalcohol displays high ability to improve the adhesiveness between the layers and to inhibit occurrence of peeling off of the layer, displacement of the image and bubble formation. Such the isocyanate compound may be added to any portion of the heat-developable photosensitive material. For example, the compound can be added in an optional layer of the photosensitive layer side of the support such as the substrate (the compound can be included in the sizing composition when the substrate is paper), the photosensitive layer, a surface protective layer, an intermediate layer, an antihalation layer and a subbing layer. The compound may be added one or more of the above layers.

Thioisocyanate compounds corresponding to the above-described isocyanate compounds also can be employed as the crosslinking agent in the invention.

The using amount of the above-described crosslinking agent is usually from 0.001 to 2 moles, and preferably from 0.005 to 0.5 moles, per mole of silver.

Though the isocyanate compounds and the thioisocyanate compounds are preferably ones functioning as the crosslinking agent, a compound having one functional group also displays good effects.

As the silane compound, those represented by Formulas 1 to 3 disclosed in Tokkai No. 2001-254930 are employable.

The epoxy compounds may be ones each having one epoxy group and the number of the epoxy group, molecular weight are not specifically limited. The epoxy group is preferably included in the molecule as a glycidyl group through an ether bonding or an imino bonding. The epoxy compound may be any of a monomer, oligomer and polymer, and the number of the epoxy group contained in the molecule is usually from 1 to 10 and preferably from 2 to 4. When the epoxy compound is polymer, the polymer either may be homopolymer or copolymer, and the number average molecular weight Mn is particularly preferably within the range of from about 2,000 to 20.000.

The acid anhydride employed in the invention is a compound having one or more acid anhydride groups represented by the following formula. There is no limitation to the number of the acid anhydride group and the molecular weight.

—CO—O—CO—

The foregoing epoxy compound and acid anhydride may be used singly or in combination of two or more kinds. Though the adding amount is not specifically limited, the amount is preferably within the range of from $1\times10^{-6}$ to $1\times10^{-2}$ moles/m$^2$, and more preferably from $1\times10^{-5}$ to $1\times10^{-3}$ moles/m$^2$. The epoxy compound or the acid anhydride compound may be added in an optional layer such as the photosensitive layer, surface protective layer, intermediate layer, antihalation layer and subbing layer. The compound can be added into one or more of the above layers.

Silver Saving Agent

The effects of the invention can be enhanced by using a silver saving agent. The silver saving agent to be used in the invention is a compound capable of reducing the amount of silver necessary to obtain a designated silver image density. Various mechanisms of the silver reducing function can be considered, and a compound having a function to raise the covering power of the developed silver is preferred. The covering power of the developed silver is the optical density per unit amount of silver.

Preferable examples of the silver saving agent include a hydrazine derivative, a vinyl compound, a phenol derivative, a naphthol derivative, a quaternary onium compound and a silane compound.

Concrete examples of the hydrazine derivative are Compounds H-1 through H-29 described in columns 11 to 20 of U.S. Pat. No. 5,545,505, Compounds 1 through 11 described in columns 9 to 11 of U.S. Pat. No. 5,464,738, Compounds H-1-1 through H-1-28, H-2-1 through H-2-9, H-3-1 through H-3-12, H-4-1 through H-4-21 and H-5-1 through H-5-5 described in paragraphs 0042 to 0052 of Tokkai No. 2001-27790.

Concrete examples of the vinyl compound are Compounds C-01 through CN-13 described in columns 13 and 14 of U.S. Pat. No. 5,545,515, Compounds HET-01 and HET-02 described in column 10 of U.S. Pat. No. 5,635,339, Compounds MA-01 through MA-07 described in columns 9 and 10 of U.S. Pat. No. 5,654,130, Compounds IS-01 through IS-04 described in columns 9 and 10 of U.S. Pat. No. 5,705,324, and Compounds 1-1 through 218-2 described in paragraph 0043 to 0088 of Tokkai No. 2001-125224.

Concrete examples of the phenol derivative and naphthol derivative are Compounds A-1 through A-89 described in paragraphs 0075 to 0078 of Tokkai No. 2000-267222 and Compounds A-1 through A-258 described in paragraphs in 0025 to 0045 of described in Tokkai No. 2003-66558.

As concrete example of the quaternary onium compound, triphenyltetrazolium is cited.

Concrete examples of the silane compound are alkoxysilane compounds having two or more primary or secondary amino groups or salts thereof such as Compound A1 through A33 described in paragraphs 0027 to 0029 of Tokkai No. 2003-5324.

The adding amount of the silver saving agent is from $1\times10^{-5}$ to 1 mole, and more preferably from $1\times10^{-4}$ to $5\times10^{-1}$ moles, per mole of silver.

Fog Inhibitor and Image Stabilizer

Fog inhibitors and image stabilizers to be used in the invention are described below.

It is preferable that a compound releasing an active species capable of inactivating a reducing agent by taking off hydrogen is contained in the photosensitive material since a reducing agent such as a bisphenol compound or a sulphonamidophenol having a proton are usually employed. A colorless photo-oxidizing agent is useful which is capable of releasing a free radical as the reactive species on the occasion of the exposure.

Accordingly, the compound may be any compound having such the function, and a free radical composed of plural atoms is preferable. A compound having any structure may be employed as long as the compound has such the function and gives no bad influence to the heat-developable photosensitive material.

The compound releasing such the radical preferably has an aromatic heterocyclic group for giving a stability to the radical so that the radical can be contacted with the reducing agent for sufficient time for inactivating the reducing agent is preferred. As the typical examples of such the compound, a biimidazolyl compound and an iodonium compound can be cited.

The adding amount of the imidazolyl compound or the iodonium compound is from 0.001 to 0.1 moles/$m^2$, and preferably from 0.005 to 0.05 moles/$m^2$. Though the compound may be contained in any constituting layers, it is preferable to be near the reducing agent.

Many compounds capable of releasing a halogen tom as the active species are known as the fog inhibitor and the image stabilizer. Concrete typical examples of the compound releasing the halogen atom are compounds represented by Formula 9 described in paragraphs 0264 through 0271.

The adding amount of these compounds is preferably within the range in which the problem of increasing of printed out silver caused by formation of silver halide is substantially not posed, and is preferably not more than 150%, and more preferably not more than 100%, of the compound not forming any active halogen radical. Concrete examples of the compound are Compounds III-1 through III-23 described in paragraphs 0086 and 0087 of Tokkai No. 2002-169249, Compounds 1-1a through 1-1o and 1-2a through 1-2o described in paragraphs 0031 to 0034 and Compounds 2a through 2z, 2aa through 211 and 2-1a through 2-1f described in paragraphs 0050 and 0056 of Tokkai No. 2003-59441, and Compounds 4-1 through 4-32 described in paragraphs 0055 to 0058 and Compounds 5-1 through 5-10 described in paragraphs 0069 to 0072 of Tokkai No. 2003-91054.

Fog inhibitors other than the above-mentioned preferably employable in the invention are described below. Examples of the fog inhibitors preferably employed in the invention are Compounds a to j described in Tokkai No. 8-314059, paragraph 0012, a thisulfonate ester A to K described in Tokkai No. 7-209797, paragraph 0028, Compounds 1 to 44 described in Tokkai No. 55-140833, p. 14, Compound I-1 to I-6 described in Tokkai No. 2002-13627, paragraph 0036 and Compounds C-1 to C-3 described in paragraph 0066 of the same document, Compounds III-1 to III-108 described in Tokkai No. 2002-90937, paragraph 0027, a vinylsulfon compound and/or a β-halosulfon compound such as Compounds VS-1 to VS-7 and HS-1 to HS-5 described in Tokkai No. 6-208192, paragraph 0013, a sulfonylbenzotriazole compound such as Compounds KS-1 to KS-8 described in Tokkai No. 2000-330235, substituted propenenitrile compounds such as Compounds PR-01 to PR-08 described in Tokuhyo 2000-515995, and Compounds (1)-1 to (1)-132 described in Tokkai No. 2002-207273, paragraph 0042 to 0051.

The above fog inhibitors are each employed in an amount of at least 0.001 moles per mole of silver. The range of the amount of the compound is usually from 0.01 to 5moles, and preferably from 0.02 to 0.6 moles, per mole of silver.

A compound known as the fog inhibitor other than the above may be contained in the heat-developable photosensitive material of the invention, such the compound either may be one capable of forming the reactive species the same as above^mentioned or one having a different fog inhibiting mechanism. Examples of such the compound are those described in U.S. Pat. Nos. 3,589,903, 4,546,075 and 4,452,885, Tokkai No. 59-57234, U.S. Pat. Nos. 3,874,946 and 4,756,999, and Tokkai Nos. 4-288238 and 9-90550. Furthermore, examples of another fog inhibitor are described in U.S. Pat. No. 5,028,523 and European Patent Nos. 600,587, 605,981 and 631,176.

When the reducing agent employed in the invention has an aromatic hydroxyl group (—OH), particularly a bisphenol compound, it is preferable to employ such the compound together with a compound having no reducing ability and a group capable of forming a hydrogen bond with such the group.

Examples of the hydrogen bond formable compound particularly preferable in the invention are Compounds III-1 to III-40 described in Tokkai No. 2002-90937, paragraphs 0061 to 0064.

Toning Agent

The heat-developable photosensitive material of the invention, in which the photographic image is formed by the thermally developing treatment, preferably contains a toning agent for controlling the tone of the silver image usually in a state of dispersed in the binder matrix, according to necessity.

Examples of the toning agent suitably employed in the invention are described in RD 17029, U.S. Pat. Nos. 4,123,282, 3,994,732, 2,846,136 and 4,021,249. Concrete examples are as follows.

An imide such as succinime, phthalimide, naphthalimide, and N-hydroxy-1,8,-naphthalimide; a mercaptane such as 3-mercapto-1,2,4-triazole; a phthaladinone derivative and it metal salt such as phthaladinone, 4-(1-naphtyl)phthaldinone, 6-chlorophthaldinone, 5,7-dimethyloxyphthaladinone, and 2,3-dihydro-1,4-phthaladinone; a combination of a phthaladine and a phthalic acid such as phthalic acid, 4-methylphthalic acid, 4-nitrophthalic acid and tetrachlorophthalic acid; a combination of phthaladine, maleic anhydride and a compound selected from the group of phthalic acid, 2,3-naphthalenedicarboxylic acid, an o-phenylenic acid derivative and its anhydride such as phthalic acid, 4-methylphthalic acid, 4-nitrophthalic acid and tetrachlorophthalic acid anhydride are employable. A combination of phthaladinone or phthaladine and a phthalic acid or phthalic anhydride is particularly preferable toning agent.

Fluorosurfactant

In the invention, a fluorosurfactant represented by the following Formula SF is preferably employed for improving the conveying ability of film and the suitability for environment (accumulation in a living body).

$$(Rf(L_1)_{n1})_p(Y)_{m1}(A)_q \qquad \text{Formula SF}$$

In the formula, Rf is a substituent having a fluorine atom, $L_1$ is a di-valent linking group having no fluorine atom, Y is (p+q)-valent linking group having no fluorine atom, A is an anionic group or its salt, $n_1$ and $m_1$ are each an integer of 0 or 1, p is an integer of from 1 to 3, q is an integer of from 1 to 3, provided that n1 and m1 are not simultaneously 0 when q is 1.

In the above Formula FS, Rf is a substituent having a fluorine atom, examples of which are an fluoroalkyl group having from 1 to 25 carbon atoms such as a trifluoromethyl group, a trifluoroethyl group, a perfluoroethyl group, a perfluorobutyl group, a perfluorooctyl group, a perfluorodecyl group and a perfluorooctadecyl group; and a fluoroalkenyl group such as a perfluoropropenyl group, a perfluorobutenyl group, a perfluorononenyl group, and perfluorododecenyl group. Rf is preferably has from 2 to 8, and more preferably from 2 to 6, carbon atoms. Rf preferably has from 2 to 12, and more preferably from 3 to 12, fluorine atoms.

$L_1$ is a di-valent linking group having no fluorine atom and examples of which are an alkylene group such as a methylene group, an ethylene group and butylene group, an alkyleneoxy group such as a methyleneoxy group, an ethyleneoxy group and a butyleneoxy group, an oxyalkylene group such as an oxymethylene group, an oxyethylene group and an oxybutylene group, a oxyalkyleneoxy group such as an oxymethyleneoxy group, oxyethyleneoxy group and an oxyethyleneoxyethyleneoxy group, a phenylene group, an oxyphenylene group, a phenyloxy group, an oxyphenylene group, an oxyphenyleneoxy group and a combination group thereof.

A is an anionic group or its salt, for example, a carboxylic acid group and its salt such as a sodium salt, a potassium salt and a lithium salt, a sulfonic acid and its salt such as a sodium salt, a potassium salt and a lithium salt, a sulfuric half ester group and its salt such as a sodium salt, a potassium salt and a lithium salt, and a phosphate group and its salt such as a sodium salt and a potassium salt.

Y is a (p+q)-valent linking group having no fluorine atom, for example, a tri- or tetra-valent linking group having a nitrogen atom or a carbon atom as the central atom, and n1 is an integer of 0 or 1 and preferably 1.

The fluorosurfactant represented by Formula SF can be obtained by introducing an anionic group by sulfuric esterification to a compound (an alkanol compound partially substituted by Rf) obtained by addition reaction or condensation reaction of a fluorinated alkyl compound having from 1 to 15 carbon atoms such as a compound having a trifluoromethyl group, a pentafluoroethyl group, a perfluorobutyl group, a perfluorooctyl group, or perfluorooctadecyl group or an alkenyl compound such as perfluorohexenyl group and a per fluorononenyl group, with an tri- to hexa-valent alkanol having no fluorine atom or a aromatic or heterocyclic compound having three or four hydroxyl groups.

Examples of the tri- to hexa-valent alkanol compound are glycerol, pentaerythrytol, 2-methyl-2-hydroxymethyl-1,3-propanediol, 2,4-dihydroxy-3-hydroxymethylpentene, 1,2,6-hexanetrio, 1,1,1-tris(hydroxymethyl)propane, 2,2-bis(butanol)-3, a aliphatic triol, tetramethylolmethane, D-sorbitol, xylitol and D-mannitol.

Examples of the above aromatic compound and the heterocyclic compound each having 3 or 4 hydroxyl groups are 1,3,5-trihydroxybenzene and 2,4,6-trihydroxypyridine.

Preferable concrete compounds of the fluorosurfactant represented by Formula SF are shown below.

SF-1

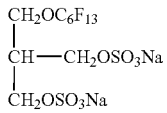

SF-2

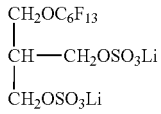

SF-3

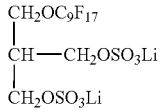

SF-4

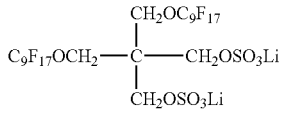

SF-5

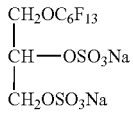

SF-6

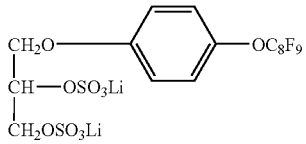

SF-7

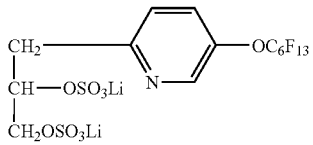

SF-8

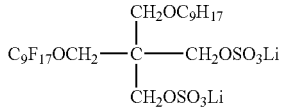

SF-9

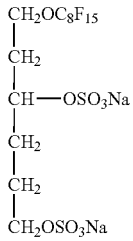

SF-10

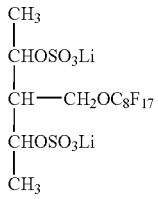

-continued

SF-11

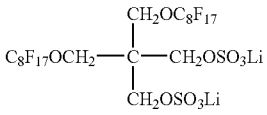

SF-12

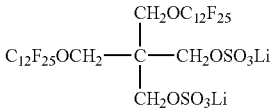

SF-13

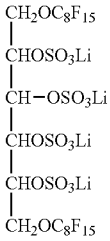

SF-14

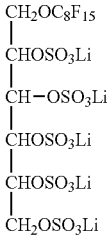

SF-15

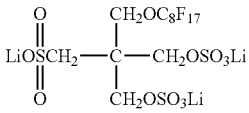

SF-16

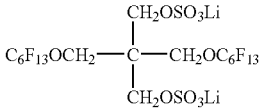

SF-17

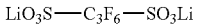

SF-18

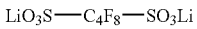

SF-19

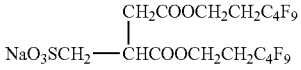

SF-20

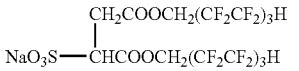

SF-21

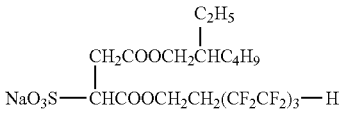

The fluorosurfactant represented by Formula SF can be added by a known method. The surfactant can be added in a form of solution in an alcohol such as methanol, ethanol, a ketone such as methyl ethyl ketone and acetone, or a polar solvent such as dimethylsulfoxide and dimethylformamide. Moreover, the surfactant can be added in a form of fine particle having a diameter of not more than 1 μm dispersed in water or an organic solvent by sand mill dispersion, jet mill dispersion, an ultrasonic dispersion or homogenizer dispersion. Many techniques are disclosed as to fine particle dispersing, the surfactant can be dispersed according to such the techniques. The fluorosurfactant represented by Formula SF is preferably added to the outermost protective layer.

The adding amount of the fluorosurfactant is preferably from $1\times10^{-8}$ to $1\times10^{-1}$ moles, particularly from $1\times10^{-5}$ to $1\times10^{-2}$ moles, per square meter. When the amount is less than the former range, desired charging property cannot be obtained, and the amount is exceeds the former range, the dependency on the humidity is increased and the storage ability is degraded under high humidity.

Surface Layer

In the invention, the ten-point average roughness Rz, the maximum roughness Rt and the center-line average roughness Ra are defined as follows according to JIS Surface Roughness B0601. The ten-point average roughness Rz is the difference in μm between the average value of the height of peaks of the highest peak through the fifth height peak measured from the line parallel with the average line and not crossing the cross section curve within the range of a standard length extruded from the cross section curve and the average value of the depth of the deepest trough through the fifth depth trough within the same range. The center-line average Ra is a value in μm represented by the following expression when the center line of the roughness within the measuring length extracted from the roughness curve in the direction of the centerline is measured on X-axis, the vertical magnification direction is measured on Y-axis and the roughness curve is expressed by y=f(x).

$$Ra = \frac{1}{L}\int_0^L |f(x)|dx$$

The Rz, Rt and Ra are measured under a condition of a temperature of 25° C. and a relative humidity of 65%; the samples to be measured are conditioned for 24 hours before the measurement under the condition in which the samples are placed so as not to be overlapped with together. The placing condition of the samples for preventing the overlapping is to wind the sample film in a state in which the edges of the film are raised, to placed a paper sheet between the films and piled, or to the fix the film at the four corners of a frame prepared by cardboard. Example of the measuring apparatus is a non-contact three-dimensional micro surface figure measuring apparatus RUSTPLUS manufactured by WYKO Co., Ltd.

The Rz, Rt and Ra of the front and back surfaces of the heat-developable photosensitive material can be easily controlled by applying-an optional combination of the following technical means.

1. The kind, average particle diameter, adding amount and surface treatment of the matting agent (an inorganic or organic powder) to be contained in the layer on the side of the image forming layer and that on the opposite side
2. Dispersing condition of the matting agent such as the kind of dispersing machine, dispersing time, the kind of beads to be used for dispersing, the average particle diameter, the amount and kind of dispersing agent to be used for dispersing, and the kind and content of polar group in the binder
3. Drying condition on the occasion of coating such as the coating speed, the distance from the nozzle for blowing drying warm air to the coated surface and the amount of air for drying, and the remaining solvent amount 4. The kind and time of filtration for filtering the coating liquid
5. The condition of the treatment such as a temperature for calendaring of from 40 to 80° C., a pressure of from 50 to 300 kg, a line speed of from 20 to 100 m and a number of nip of from 2 to 6 When the calender treatment is applied.

In the invention, the value of Ra(E)/Ra(B) is preferably from 0.6 to 1.3, and more preferably from 0.7 to 1.1, within the range of from 0.6 to 1.5 described in the foregoing Item 3. By making the ratio into the above range, the conveying ability of the film is improved and the occurrence of the density unevenness on the occasion of the thermal development is considerably inhibited among the effects of the invention.

In the image forming method of the invention, a ratio of Lb/Le is preferably from 2.0 to 10, and more preferable from 3.0 to 4.5, in which Le (μm) is the average particle diameter of the matting agent having the highest average particle diameter contained in a layer on the image forming layer side and Lb (μm) is the average particle diameter of the matting agent having the highest average particle diameter contained in a layer on the back-coat layer side. By making the above ratio into the above range, the density unevenness of the thermally developed image can be particularly improved in the effects of the invention. In the image forming method of the invention, the value of Rz(E)/Ra(E) is preferably from 12 to 60, and more preferably from 14 to 50. By making the value of Rz(E)/Ra(E) into such the range, the density unevenness and the storage ability for a long time can be improved among the effects of the invention. In the image forming method of the invention, the value of Rz(B)/Ra(B) is preferably from 25 to 65, and more preferably from 30 to 60. By making the value of Rz(B)/Ra(B) into such the range, the density unevenness and the storage ability for a long time can be particularly improved among the effects of the invention.

The powder employed in the invention is preferable is a powder having a Moh's hardness of not less than 5. Know inorganic powder and organic powder van be optionally selected for the use.

Examples of the inorganic powder include a powder of titanium oxide, boron nitride, $SnO_2$, $SiO_2$, $Cr_2O_3$, $\alpha$-$Al_2O_3$, $\alpha$-$Fe_2O_3$, $\alpha$-FeOOH, SiC, cilium oxide, corundum, artificial diamond, garnet, mica, silica rock, silicon nitride and silicon carbide. Examples of the organic powder include a powder of poly(methyl methacrylate), polystyrene and Teflon®. Among them, the inorganic powder such as that of $SiO_2$, titanium oxide, barium sulfate, $\alpha$-$Al_2$, $\alpha$-$Fe_2O_3$, $\alpha$-FeOOH, $Cr_2O_3$, and mica are preferable, in which the powder of $SiO_2$ and $Al_2O_3$ are more preferable, and $SiO_2$ is particularly preferred.

In the invention, the powder is preferably subjected to a surface treatment. The formation of the surface treatment layer is carried out as follows. The raw material of the inorganic powder is powdered in a dry state, and water and a dispersing agent are added and further powdered in a wet state, and then coarse particles are separated by a centrifugal method; after that, the slurry of fine particles is moved into a surface treatment tank in which covering by metal oxide is carried out. A designated amount of an aqueous solution of a salt of metal such as Al, Si, Ti, Zr, Sb, Sn or Zn is added to the slurry and the mixture is neutralized by an acid or an alkali so that the inorganic particle surface is covered by thus formed hydrated metal oxide. Water soluble salts formed as byproducts are removed by decantation, filtration and washing, and the pH of the slurry is finally controlled and washed by purified water. The washed cake is dried by a spray drier or a pan dryer. The dried matter is finally powdered by a jet mill so as to be made the product. The surface treatment by Al or Si can be performed, other than the aqueous treatment, by passing the vapor of $AlCl_3$ or $SiCl_4$ through the non-magnetic inorganic particles and then introducing steam. As to another surface treatment method, "Characterization of Powder Surfaces" J. Academic Press can be referred.

In the invention, it is preferable that the powder is treated on the surface with a Si compound or an Al compound. The surface state of the outermost layer can be improved by the use of such the surface treated powder. The content of Si is preferably from 0.1 to 10%, more preferably from 0.1 to 5%, and particularly preferably from 0.1 to 2%, by weight of the powder, and that of Al is preferably from 0.1 to 10%, more preferably from 0.1 to 5%, and particularly preferably from 0.1 to 2%, by weight of the powder. The weight ratio of Si and Al is preferably Si<Al.

The surface treatment can be performed by the method described in Tokkai 2-83219. In the invention, the average particle diameter of the powder is an average diameter in spherical particles, an average length of the major axis in needle-like shaped particles and an average of the longest diagonal length in planer particles, which can be easily determined by electron microscopic measurement.

The average particle diameter of the organic or inorganic powder is preferably from 0.5 to 10 μm, and more preferably from 1.0 to 8.0 μm.

The average particle diameter of the organic or inorganic powder contained in the outermost layer on the image forming layer side is usually from 0.5 to 8.0 μm, preferably from 1.0 to 6.0 μm, and more preferably from 0.2 to 5.0 μm. The adding amount is usually from 1.0 to 20% by weight, preferably from 2.0 to 15% by weight, and more preferably from 3.0 to 10% by weight, of the amount of the binder including the amount of the crosslinking agent. The average particle diameter of the organic or inorganic powder contained in the outermost layer on the opposite side of the support is usually from 2.0 to 15.0 μm, preferably from 3.0 to 12.0 μm, and more preferably from 4.0 to 12.0 μm. The adding amount is usually from 0.2 to 10% by weight, preferably from 0.4 to 7% by weight, and more preferably from 0.6 to 5% by weight, of the amount of the binder including the amount of the crosslinking agent.

The variation coefficient of the particle size distribution is preferably not more than 50%, more preferably not less than 40%, and particularly preferably not more than 30%. The variation coefficient of the particle size distribution is a value expressed by the following expression.

$$\{(\text{Standard deviation of particle diameter})/(\text{Average value of particle diameter})\}\times 100$$

The organic or inorganic powder may be either added by a method in which the powder is previously dispersed in the coating liquid or a method in which the powder is sprayed onto the coated surface of the coating liquid before drying the coated layer. Both of the method may be applied with together when plural kinds of the powder are added.

Support

As the raw material of the heat-developable photosensitive material of the invention, various kinds of polymer, glass, wool cloth, cotton cloth, paper, and metal such as aluminum are employable. Elastic ones capable of being formed in a sheet or a roll are suitable for handling as an information-recording medium.

Therefore, plastic film such as cellulose acetate film, polyester film, polyethylene terephthalate film, polyethylene naphthalate film, polyamide film, polyimide film, cellulose triacetate film and polycarbonate film, is preferable as the support in the heat-developable photosensitive material of the invention. Two dimensionally elongated polyethylene terephthalate film is particularly preferred in the invention. The thickness of the support is approximately from 50 to 300 μm, and preferably from 70 to 180 μm.

In the invention, it is preferable that the surface protective layer on the baking layer side contains electroconductive metal oxide. It is found that the effects of the invention, particularly the conveying ability on the occasion of the thermal development, are enhanced by the presence of such the metal oxide. The electroconductive metal oxide is a crystalline metal oxide particle, and ones containing an oxygen defect or a little amount of different atom capable of forming a donor to the metal oxide are preferred since such the metal oxide is generally high in the electroconductivity and the later is particularly preferable since is does not give fogging to the silver halide emulsion.

As examples of the metal oxide, ZnO, $TiO_2$, $SnO_2$, $Al_2O_3$, $In_2O_3$, $SiO_2$, MgO, BaO, $MoO_3$, $V_2O_5$ and a composite oxide thereof are suitable, and ZnO, $TiO_2$ and $SnO_2$ are particularly preferable. As examples of metal oxide containing different atom, addition of Al or In to ZnO, that of Sb, Nb, Poor a halogen atom to $SnO_2$, and that of Nb or Ta to $TiO_2$, are effective. The adding amount of the different atom is preferably from 0.01 to 30 mole-percent, and particularly preferably from 0.1 to 10 mole-percent. Moreover, a silicon compound may be added on the occasion of the fine particle preparation for improving the dispersion ability and the transparency. The metal oxide fine particle employed in the invention has electroconductivity, and the volume resistance is not more than $10^7$ Ω·cm, and particularly not more than $10^5$ Ω·cm. These metal oxides are described in Tokkai Nos. 56-143431, 56-120519 and 58-62647. Moreover, an electro conductive material constituted by the metal oxide constituting on another crystalline metal oxide particle or a fiber shaped substance such as titanium oxide may be employed.

The particle size is preferably not more than 1 μm, and the particle of not more than 0.5 μm is easily employed since it shows high stability after the dispersion. The electroconductive particle having a diameter of not more than 0.3 μm is specifically preferable for reducing light scattering as small as possible, by the use of which transparence photosensitive material can be obtained. When the electroconductive metal oxide has needle like shape or fiber like shape, the length and diameter of it is each preferably mot more than 30 μm and not more than 1.0 μm, particularly preferably not more than 10 μm and not more than 0.3 μm, respectively, and the ratio of length/diameter is not less than 3. As the $SnO_2$, SNS10M, SN-100P, SN-100D and FSS10M which are on sale from Ishihara Sangyo Co., Ltd., are employable.

The heat-developable photosensitive material according to the invention has at least one image forming layer. It is preferable that at least one non-photosensitive layer is provided on the image forming layer even though the material may be constituted by forming only the image forming layer on the support. For example, a protective layer is preferably provided on the image forming layer for protecting the image forming layer; and a backing layer is provided on the opposite surface of the support for preventing adhesion the heat-developable photosensitive material sheets with another sheets or in the roll of the heat developable photosensitive material. As the binder to be employed in the protective layer and the backing layer, polymer having a glass transition point higher than that of the image forming layer and a high resistivity against occurrence of scratches and deformation such as cellulose acetate and cellulose acetate-butylate is selected from the foregoing binders.

Two or more image forming layers may be provided on the one side or one or more image forming layers on the both sides of the support.

Dye

In the invention, it is preferable to form a filter layer on the side of the image forming layer or on opposite side, or to contain a dye or pigment in the image forming layer for controlling the amount or the wavelength distribution of light passing through the image forming layer.

Known compounds capable of absorbing various wavelength regions of light can be employed corresponding to the spectral sensitivity of the photosensitive material. For example, a squalylium dye having a thiopyrylium nucleus (in the invention, referred to as a thiopyrylium-squalylium dye) and that having a pyrylium nucleus (in the invention, referred to as a pyrylium-squalylium dye) described in Tokkai 2001-83655, and a thiopyrylium-chroconium dye or a pyrylium-chroconium dye similar to the squalylium dye are preferably employed when the heat-developable photosensitive material is an infrared image recording material.

The compound having the squalylium nucleus is a compound having 10cyclobutene-2-hydroxy-4-one in the molecular structure thereof. The hydroxyl group may be in a dissociated state. In this specification, these dyes are collectively called as squalylium dye for the sake of convenience. The compounds described in Tokkai 8-201595 are preferable as the dye.

Coating of Constituting Layers

The heat-developable photosensitive material is preferably prepared by the procedure in which coating liquids are prepared by the raw materials of each of the constituting layers are dissolved or dispersed in an solvent and the coating liquids are simultaneously coated to form a multiply coated layer and then coated layers are treated by heating. The term of "simultaneously coating multiple layers" means that the constituting layers can be formed under a condition in which the processes for coating and drying of the constituting layers can be simultaneously carried out on the occasion of the preparation of the coating liquids for each constituting layers such as the photosensitive layer and the protective layer and the coating them on the support. Namely, the upper layer is provided onto the lower layer before the remaining amount of the whole solvents in the lower layer is attained at an amount of not more than 70% by weight.

The method for simultaneously coating plural layers is not specifically limited, for example, known methods such as a bar coater method, a curtain coating method, a dipping method, an air knife method, a hopper coating method, and extrusion coating method are applicable. Among them, a previously measuring type coating method so-called extrusion coating method is preferable. The extrusion coating method is suitable for precision coating and organic solvent coating since the solvent evaporated from the sliding surface such as occurring in the slide coating method does not occur. Though such the coating method is described as to the coating on the photosensitive layer side, the situation is the same as to the coating of the backing layer together with the subbing layer. The simultaneously coating of plural layers is described in detail in Tokkai 2001-15173.

In the invention, it is preferable that the coating amount of silver is decided a suitable amount corresponding to the using object of the heat-developable photosensitive material.

For medical image formation, an amount of from 0.3 to 1.5 $g/m^2$ is preferable and that of from 0.5 to 1.5 $g/m^2$ is more preferable. Silver derived from the silver halide preferably accounts for from 2 to 18%, and more preferably from 5 to 15%, of the coating amount of silver.

In the invention, the coated density of the silver halide particle having a sphere corresponding particle diameter of not less than 0.01 μm is preferably from $1\times10^{14}$ to $1\times10^{18}$, and more preferably from $1\times10^{15}$ to $1\times10^{17}$, particles per square meter.

When the coating is carried out within the above range of the condition, suitable results can be obtained from the viewpoints of the maximum optical density per a unit silver coating amount or the covering power of silver and the tone of silver image.

In the invention, it is preferable that the heat-developable photosensitive material contains the solvent in an amount of within the range of from 100 to 500 $mg/m^2$. The amount of the solvent is more preferably controlled so as to be from 100 to 500 $mg/m^2$. By such the control, the heat-developable photosensitive material having high sensitivity, low fogging and high maximum density can be formed.

As the solvent, those described in Tokkai 2001-264930, paragraph 0030, are usable but the solvent is not limited to them. These solvent can be employed singly or in combination of plural kinds of them.

The content of the solvent in the heat-developable photosensitive material can be controlled by the variation of the temperature in the drying process after the coating process. The content of the solvent can be measured by gas chromatography under a suitable condition for detecting the contained solvent.

Package

When the heat-developable photosensitive material of the invention is stored, the photosensitive material is preferably packed by a packaging material having low oxygen permeability and/or moisture permeability for preventing the density variation, occurrence of fogging, and for improving the curing and rolling habit. The oxygen permeability is preferably not more than 50 $ml/atm\cdot m^2\cdot day$ (1 atm is $1.01325\times10^5$ Pa), more preferably not more than 10 $ml/atm\cdot m^2\cdot day$, and further preferably not more than 1.0 $ml/atm\cdot m^2\cdot day$. The moisture permeability is preferably not more than 10 $g/atm\cdot m^2\cdot day$ (1 atm is $1.01325\times10^5$ Pa), more preferably not more than 5 $g/atm\cdot m^2\cdot day$, and further preferably not more than 1 $g/atm\cdot m^2\cdot day$. Examples of the packaging material for the heat-developable photosensitive material are those described in Tokkai Nos. 8-254793, 2000-206653, 2000-235241, 2002-062625, 2003-015261, 2003-057790, 2003-084397, 2003-098648, 2003-098635, 2003-107635, 2003-131337, 2003-146330, 2003-226439 and 2003-228152. The space ratio is preferably from 0.01 to 10%, and more preferably from 0.02 to 5%, and it is preferable to fill nitrogen so that the partial pressure of nitrogen is not less than 80%, and more preferably not less than 90%. The relative humidity in the package is preferably from 10% to 60%, more preferably from 40% to 55%.

Exposure to the Heat-Developable Photosensitive Material

The characteristics of the heat-developable photosensitive material of the invention are displayed when the material is exposed to high illuminance light of not less than 1 $mW/mm^2$ for short time. The illuminance is that necessary to form an optical density of 3.0. When the exposure is carried out by such the high illuminance light, required image density can be obtained by small light amount (illuminance× exposure time) and a high sensitive system can be designed. The illuminance is more preferably from 2 $mW/mm^2$ to 50 $mW/mm^2$, and further preferably from 10 $mW/mm^2$ to 50 $mW/mm^2$. Though any light source may be employed as long as it has such the illuminance, such the illuminance can be preferably attained by laser light. Light of a gas laser ($Ar^+$, $Kr^+$, He—Ne), a YAG laser, a dye laser and a semiconductor laser are preferably applied in the invention. The semiconductor laser and a secondary harmonics generation element are also employable. A semiconductor emitting blue to violet light (one having a peak intensity at a wavelength in the range of from 350 nm to 440 nm) is further preferred. Example of the blue to violet light emitting semiconductor laser is NLHV 3000E semiconductor laser manufactured by Nichia Kagaku Co., Ltd.

In the invention, the exposure is preferably carried out by scanning by laser light, and various methods can be applied for the exposure. The first preferable method is a method using a laser scanning exposure apparatus in which the angle of the scanning laser light to the surface of heat-developable photosensitive material to be exposed is substantially not perpendicular.

The terms of "substantially not perpendicular" means that the angle of scanning laser light is preferably from 55 to 88°, more preferable from 60 to 86°, further preferably from 65 to 84°, and most preferably from 70 to 82°, when the angle of the light is nearest a right angle during the scanning.

The diameter of the beam spot at the exposing surface of the photosensitive material on the occasion of the photosensitive material is exposed to laser light is preferably not more than 200 μm, and more preferably not more than 100 μm. The spot diameter is preferably smaller since the shift of the incident angle of the laser light from the perpendicular can be reduced. The lower limit of the beam spot diameter is 10 μm. By performing such the laser light exposure, image degradation relating to the reflected light such as occurrence of interference fringe-like density unevenness can be reduced.

As the second method, a method using an laser scanning exposing apparatus in which scanning laser light in a vertical multiple mode is emitted is also preferable. By such the method, degradation of the image quality such as occurrence of the interference fringe-like density unevenness is reduced. For forming the vertical multiple mode light, methods by wave synthesizing, utilizing return light, and by overlapping high frequency wave are preferable. The "vertical multiple mode" means that the exposing light is not single wavelength light, and the wavelength distribution width of the exposure light is usually not less than 5 nm, and preferably not less than 10 nm. The upper limit to the wavelength distribution width is usually 60 nm, even though it is not specifically limited.

As the third embodiment, a method is preferable in which the image is formed by scanning exposure using two or more laser light beams. The method using a plurality of laser light beam is the technique applied for means for writing plural lines by once scanning in laser printer or digital copying machine to respond requirements of high resolution of image and high speed printing. Such the technique is disclosed in, for example, Tokkai No. 60-166916. In such the method, laser light beam emitted from a light source unit is swung for scanning by a polygon mirror and focused on the photosensitive material through an fθ lens. Such the apparatus is a laser scanning optical apparatus based on the same principle as that of laser imager.

In the image writing means of the laser printer and the digital copying machine, the next laser beam is focused at a position moved for one line space from the focusing position of one laser light beam for writing plural lines of image by once scanning. In concrete, the two light beams are adjacent with together for a distance of several ten micrometer in the direction of sub-scanning on the image face. When the writing density is 400 dpi (dpi is number of dot per 1 inch or 2.45 cm), the pitch in the sub-scanning direction is 63.5 μm and when the writing density is 600 dpi, the pitch is 42.3 μm. In the invention, it is preferred that the two or more laser light beams are focused at the same point by varying the angle of the light beams for forming the image, different from the above method in which the beams are moved for a distance corresponding to the resolution. In such the case, the energy of the exposing light is preferably within the range of $0.9\times E \leqq En\times N \leqq 1.1\times E$, when E is the exposing energy at the exposing surface for writing an image by usual one laser light beam, and N beams used for exposure are the same as in the wavelength (λ nm) and in the exposing energy (En). Under such the condition, the reflection of each of the beams is reduced since the exposing energy of the individual light beam is small so that the occurrence of the interference fringe is inhibited even though the energy at the exposing surface can be maintained.

Though plural laser beams having the same wavelength are employed in the above, beams each different in the wavelength may be applied. In such the case, it is preferable that the wavelength is within the range of $(\lambda-30)<\lambda 1, \lambda 2, \ldots \lambda n \leqq (\lambda+30)$ with respect to λ nm.

The diameter of the beam spot on the heat-developable photosensitive material surface to be scanned in the laser imager or the laser image setter is usually from 5 to 75 μm in the minor axis direction and from 5 to 100 μm in the major axis direction, and the scanning speed by the laser beam may be suitably set for each of the heat-developable materials according to the peculiar sensitivity at the wavelength of the emitted light of laser and the power of the laser.

Thermal Developing Apparatus

The thermal developing apparatus in the invention is constituted by a film supplying part represented by a film tray, a laser image recording part, a thermal developing part for uniformly and stably applying heat to the heat-developable photosensitive material, and a conveying part for conveying the heat developable photosensitive material from the film supplying part, through the laser recording part, and output the heat-developable photosensitive material on which an image is formed by the thermal development. A concrete example of such the embodiment of the thermal development apparatus is shown in FIG. 1.

The thermal developing apparatus 100 has a supplying part 110 for supplying the heat-developable photosensitive material sheets (referred to as photothermographic element or simply film) one by one, a developing part 120 for exposing the supplied film F, a developing part 130 for developing exposed film F, and a cooling device for stopping the development and a stacking device 160, and a supplying roller pair 140 for supplying the film from the supplying part, a supplying roller pair 144 for conveying the film to the developing part, and plural conveying roller pairs 141, 142, 143 and 145 for smoothly conveying the film through each of the parts are equipped. The thermal developing part is constituted by a heating drum 1 having a plurality of counter roller for heating the film F while contacting the film to the circumference of the drum, and a peeling craw for peeling and conveying the film F to the cooling device.

The conveying speed of the heat-developable photosensitive material is preferably from 10 to 200 mm/sec. Particularly, the conveying speed is preferably from 10 to 200 mm/sec in the thermal developing part, from 10 to 200 mm/sec between the photosensitive material supplying part to the image exposing part, from 10 to 200 mm/sec in the image exposing part, and 20 to 200 mm/sec in the thermal developing part. By setting the conveying speed within the above range, the density unevenness on the occasion of the thermal development can be improved and the time for the treatment can be shorten so as to be able to respond to emergency diagnosis.

The typical development of the heat-developable photosensitive material is carried out by heating the imagewise exposed heat-developable photosensitive material at a suitable high temperature even though the condition is varied depending on the machine, apparatus or means to be employed. The latent image formed by exposure is developed by heating at an intermediate high temperature (approximately from 80 to 200° C., and preferably from 100 to 200° C.) for satisfactory time (usually approximately from 1 second to 2 minutes, preferably from 3 to 30 seconds, and more preferably from 5 to 20 seconds).

When the heating temperature is less than 80° C., sufficient image density cannot be obtained in a short duration, and when the temperature exceeds 200° C., the binder is molten and bad influences occur on not only the image but on the conveying property and the developing device such as transfer of the image on the roller. The image is formed by the redox reaction between the organic silver salt (functions as an oxidizing agent) and the reducing agent by heating. The reaction is progressed without externally supplying any processing liquid such as water.

As the apparatus, device or means for heating, a typical heating means such as a hot plate, an iron, a hot roller, and a heat generation means using carbon or white titania are employable. The heat-developable photosensitive material having the protective layer is preferably developed by heating while contacting the surface having the protective layer with the heating roller from the viewpoint of uniformly heating, heat efficiency and operating suitability.

EXAMPLES

Though the invention is described in detail below, the embodiment of the invention is not limited to them. Percent (%) in the examples is weight-percent as long as specific description is not attached.

Example 1

<<Preparation of Subbed Photographic Support>>

Subbed support for photographic use was prepared by subbing blue tinted 175 μm polyethylene terephthalate film which is prepared by two-dimensionally elongated and thermally fixed and subjected to corona discharge treatment of 8 W·minute/$m^2$ on both sides thereof. Namely, Subbing Coating Liquid a-1 was coated on a surface of the photographic support at a rate of 100 m/minute at 22° C. so that the dry thickness of the layer is made to 0.2 μm, and dried at 140° C. to form an image forming side subbing layer (referred to as Lower Subbing Layer A-1). The following Subbing Coating Liquid b-1 was coated on the opposite side of the photographic support at a rate of 100 m/minute at 22° C. so that the dry thickness of the layer is made to 0.12 μm, and dried at 140° C. to form an back side subbing layer having an antistatic function (referred to as Lower Subbing Layer B-1). The surface of Lower Subbing Layer A-1 and that of Lower Subbing Layer B-1 were subjected to corona discharging treatment of 8 W·minute/$m^2$. And then the following Subbing Coating Liquid a-2 was coated on the Lower Subbing Layer A-1 at a rate of 100 m/minute and 33° C. and dried at 140° C. to form Upper Subbing Layer A-2 having a dry layer thickness of 0.03 μm. The following Subbing Coating Liquid b-2 was coated on the Lower Subbing Layer B-1 at a rate of 100 m/minute and 33° C. and dried at 140° C. to form Upper Subbing Layer B-2 having a dry layer thickness of 0.2 μm. And then the support was heated at 123° C. for 2 minutes and wound up under a condition of 25° C. and 50% RH. Thus subbed sample was prepared.

Blue Dye

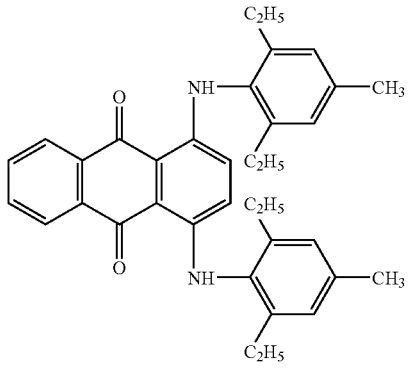

Preparation of Solution of Aqueous Polyester A-1

A mixture of 35.4 parts by weight of dimethyl terephthalate, 33.63 parts by weight of dimethyl iso-phthalate, 17.92 parts by weight of sodium salt of dimethyl sulfoisophthalate, 62 parts by weight of ethylene glycol, 0.065 parts by weight of calcium acetate monohydrate, and 0.022 parts by weight of manganese acetate tetrahydrate was subjected to ester exchanging reaction under nitrogen stream at 170 to 220° C. while distilling out methanol. And then 0.04 parts by weight of trimethyl phosphate and 0.04 parts by weight antimony trioxide as a catalyst and 6.8 parts by weight of 1,4-cyclohexane carboxylic acid were added and esterizing reaction was carried out at 220 to 235° C. while distilling out almost the theoretical amount of water.

After that, the pressure and the temperature in the reaction system were each increased and decreased, respectively, spending 1 hour and the polymerization-condensation reaction was finally carried out for 1 hour at 280° C. and not more than 133 Pa to synthesize aqueous polyester A-1. Thus obtained aqueous polyester A-1 had an intrinsic viscosity of 0.33, an average particle diameter of 40 nm and a Mw of from 80,000 to 100,000.

Into a 2 litter three-mouth flask attached with a stirrer, a reflux condenser and a thermometer, 850 ml of purified water was charged and then 150 g of aqueous polyester A-1 was gradually added while rotating the stirrer. After stirring for 30 minutes at the room temperature, the mixture was heated for 1.5 hours so that the interior temperature become 98° C., and held at this temperature for 3 hours to dissolve the polyester by heating. After the completion of the heating, the solution was cooled by the room temperature spending 1 hour, and stood for one night to prepare a 15 weight-percent aqueous polyester A-1 solution.

Preparation of Solutions of Modified Aqueous Polyester B-1 and B-2

Into a 3 liter four-mouth flask attached with a stirrer, a reflux condenser, a thermometer and a dropping funnel, 1900 ml of the 15 weight-percent aqueous polyester A-1 solution was charged and the temperature in the flask was raised by 80° C. while rotating the stirrer. To the solution, 6.52 ml of a 24 weight-percent solution of ammonium peroxide was added and a monomer mixture (composed of 28.5 g of glycidyl methacrylate, 21.4 g of ethyl acrylate and 21.4 g of methyl methacrylate) was dropped spending 30 minutes and the reaction was further continued for 3 hours. After that, the solution was cooled by 30° C. and filtered to prepare a modified aqueous polyester B-1 solution having a solid component concentration of 18% by weight (vinyl component modifying ratio of 20% by weight).

A modified aqueous polyester B-2 solution having a solid component concentration of 18% by weight (vinyl component modifying ratio of 20% by weight) was prepared in the same manner as in the modified aqueous polyester B-1 solution except that the vinyl modifying ratio was changed to 36% by weight and the modifying composition was changed to styrene:glycidyl methacrylate:acetoacetoxyethyl methacrylate:n-butyl acrylate =39.5:40:20:0.5.

Preparation of Acryl Type Polymer Latexes C-1 Through C-3

Acryl type polymer latexes C-1 through C-3 having the monomer composition shown in Table 1 were synthesized by emulsion polymerization. Solid content was all 30% by weight.

TABLE 1

| Latex No. | Monomer composition (weight ratio) | Tg (° C.) |
|---|---|---|
| C-1 | Styrene:glycidyl methacrylate:n-butyl acrylate = 20:40:40 | 20 |
| C-2 | Styrene:n-butyl acrylate:t-butyl acrylate: hydroxyethyl methacrylate = 27:10:35: 28 | 55 |
| C-3 | Styrene:glycidyl methacrylate: acetoacetoxyethyl methacrylate = 40:40:20 | 50 |

<<Water-Soluble Polymer Containing Poly(vinyl Alcohol) Unit>>

D-1: PVA-617 (aqueous dispersion (solid content: 5%): saponification degree 95) (Kuraray Co. Ltd)

| [Image forming layer side lower subbing layer coating liquid a-1] | |
|---|---|
| Acryl type polymer latex C-3 (Solid content: 30%) | 70.0 g |
| Aqueous dispersion of ethoxized alcohol and ethylene polymer | 5.0 g |
| Surfactant A | 0.1 g |

The above-mentioned was finished to 1,000 ml by adding distillated water to prepare the coating liquid.

| [Image forming layer side upper subbing layer coating liquid a-2] | |
|---|---|
| Modified aqueous polyester B-2 (18% by weight) | 30.0 g |
| Surfactant A | 0.1 g |

-continued

| [Image forming layer side upper subbing layer coating liquid a-2] | |
|---|---|
| True spherical silica matting agent (Nihon Shokubai Co., Ltd., Seahostar EK-P50 | 0.04 g |

The above-mentioned was finished to 1,000 ml by adding distillated water to prepare the coating liquid.

| [Backing layer side lower subbing layer coating liquid b-1] | |
|---|---|
| Acryl type polymer latex C-1 (Solid content: 30%) | 30.0 g |
| Acryl type polymer latex C-2 (Solid content: 30%) | 7.6 g |
| $SnO_2$ sol (synthesized according to the method described in Example 1 of Tkkou No. 35-6616 and concentrated by heating so that the solid content was 10% by weight, and the pH thereof was adjusted 10 by ammonia water) | 180 g |
| Surfactant A | 0.5 g |
| PVA-613 (PVA manufactured by Kuraray Co., Ltd.) | 5 |
| weight-percent aqueous solution | 0.4 g |

The above-mentioned was finished to 1,000 ml by adding distillated water to prepare the coating liquid.

| [Backing layer side upper subbing layer coating liquid b-2] | |
|---|---|
| Modified aqueous polyester B-1 (18% by weight) | 145.0 g |
| True spherical silica matting agent (Nihon Shokubai Co., Ltd., Seahostar EK-P50 | 0.2 g |
| Surfactant A | 0.1 g |

The above-mentioned was finished to 1,000 ml by adding distillated water to prepare the coating liquid.

The following back-coat layer and back-coat protective layer were coated on the subbing layer B-2 provided on the support.

<Preparation of Back-Coat Layer Coating Liquid>

To 830 g of methyl ethyl ketone (MEK), 84.2 g of cellulose acetate-propionate CAP482-20 manufactured by Eastman Chemical Co., Ltd.) and 4.5 g of polyester resin (Vitel PE2200B manufactured by Bostic Co., Ltd.) were added and dissolved while stirring. To the resultant solution, 4.5 g of fluorosurfactant (Surflon KH40 manufactured by Asahi Glass Co., Ltd.) and 2.3 g of fluorosurfactant (Megafagg F-120K manufactured by Dainihon Ink Co., Ltd.) dissolved in 43.2 g of methanol was added and satisfactorily stirred for completely dissolving. Then 2.5 g of oleyl oleate was added. Finally, 75 g of silica (average particle diameter is shown in Table 2) dispersed in MEK by a dissolver type homogenizer in a concentration of 1% was added and stirred to prepare a back-coat layer coating liquid.

<Preparation of Back-Coat Protective Layer (Surface Protective Layer) Coating Liquid>

A back-coat protective layer coating liquid was having the following composition was prepared in the same manner as in the back-coat layer. The dissolver type homogenizer was employed for dispersing the silica.

| | |
|---|---|
| Cellulose acetate-propionate (10% MEK solution) (CAP482-20, manufactured by Eastman Chemical Co., Ltd.) | 15 g |

-continued

| | |
|---|---|
| Monodispersed silica having a monodispersion degree of 15% (Average diameter: Described in Table 2) (Surface treated by aluminum in an amount of 1% of the silica) | 0.03 g |
| $C_8H_{17}(CH_2CH_2O)_{12}C_8H_{17}$ | 0.05 g |
| Fluorosurfactant (SF-17) | 0.01 g |
| Stearic acid | 0.1 g |
| Oleyl oleate | 0.1 g |
| α-Alumina (Moh's hardness: 9) | 0.1 g |
| Surfactant (A) | |

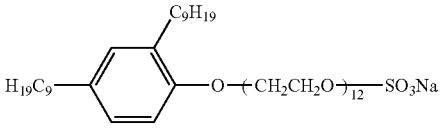

<Preparation of Silver Halide Photosensitive Emulsion A>

| | |
|---|---|
| (A1) | |
| Phenylcarbamoyl-modified gelatin | 88.3 g |
| Compound (AO-1), 10% methanol-aqueous solution | 10 ml |
| Potassium bromide | 0.32 g |
| Water to make | 5429 ml |
| (B-1) | |
| 0.67 mole/L silver nitrate aqueous solution | 2635 ml |
| (C-1) | |
| Potassium bromide | 50.69 g |
| Potassium iodide | 2.66 g |
| Water to make | 660 ml |
| (D1) | |
| Potassium bromide | 151.6 g |
| Potassium iodide | 7.67 g |
| Potassium hexachloroiridate (IV), (1% aqueous solution of $K_2$ ($IrCl_6$)) | 0.93 ml |
| Potassium hexacyanofrrate (II) | 0.004 g |
| Potassium hexachloroosmate (IV) | 0.004 g |
| Water to make | 1982 ml |
| (E1) | |
| 0.4 moles/L potassium bromide aqueous solution An amount necessary to controlling silver electrode potential as follows | |
| (F-1) | |
| Potassium hydroxide | 0.71 g |
| Water to make | 20 ml |
| (G-1) | |
| 56% aqueous solution of acetic acid | 18 ml |
| (H-1) | |
| Sodium carbonate anhydrate | 1.72 g |
| Water to make | 151 ml |
| AO-1: $HO(CH_2CH_2O)_n\{CH(CH_3)CH_2O\}_{17}(CH_2CH_2O)_mH$ (m + n = 5 to 7) | |

To solution A-1, ¼ of solution B-1 and the entire amount of solution C-1 were added spending 4 minutes and 45 seconds by a simultaneous mixing method while controlling the temperature at 20° C. and the pH at 8.09 by using a stirring mixer disclosed in Tokkou 58-58288 to prepare nuclei. After 1 minute, the entire amount of solution F-1 was added. During the above process, the pAg was optionally controlled by using solution E-1. After standing for 6 minutes, ¾ of solution B-1 and the entire amount of solution D-1 were added spending 14 minutes and 15 seconds by a simultaneous mixing method while controlling the temperature at 20° C. and the pH at 8.09. After stirring for 5 minutes, the temperature of the system is lowered by 40° C. and the entire amount of solution G-1 was added for precipitating the silver halide emulsion. The supernatant was removed for remaining 2000 ml of precipitated portion and then 10 liter of water was added. After stirring, silver halide emulsion was re-precipitated. After that, the supernatant was removed for remaining 1500 ml of precipitated portion and then 10 liter of water was added and stirred. And then the supernatant was removed for remaining 1500 ml of precipitated portion and then solution H-1 was added, and the temperature was raised by 60° C., and the emulsion was further stirred for 120 minutes. Finally, the pH was adjusted to 5.8 and water was added so that the weight was 1161 g per mole of silver to prepare photosensitive silver halide emulsion A.

Thus obtained emulsion was a monodispersed cubic silver iodobromide emulsion (AgI content: 3.5 mole-percent) having an average particle size of 25 nm, a variation coefficient of particle size of 12%, and a [100] face ratio of 92%.

<Preparation of Silver Halide Photosensitive Emulsion B>

Silver halide photosensitive emulsion B was prepared in the same manner as in silver halide photosensitive emulsion A except that the temperature on the occasion of the simultaneous mixing was changed to 45° C. Thus obtained emulsion was a monodispersed cubic silver iodobromide emulsion (AgI content: 3.5 mole-percent) having an average particle size of 55 nm, a variation coefficient of particle size of 12%, and a [100] face ratio of 92%.

<Preparation of Silver Halide Photosensitive Emulsion C>

Silver halide photosensitive emulsion C was prepared in the same manner as in silver halide photosensitive emulsion A except that the potassium bromide employed in photosensitive silver halide emulsion A was replaced by potassium iodide. Thus obtained emulsion was a monodispersed silver iodide emulsion having an average particle size of 25 nm, a variation coefficient of particle size of 12%, and a [100] face ratio of 92%.

<Preparation of Silver Halide Photosensitive Emulsion D>

Silver halide photosensitive emulsion D was prepared in the same manner as in silver halide photosensitive emulsion A except that a part of the potassium bromide employed in photosensitive silver halide emulsion A was replaced by potassium iodide so that the silver iodide content of the emulsion become to 90 mole-percent. Thus obtained emulsion was a monodispersed silver iodobromide emulsion (AgI content: 90 mole-percent) having an average particle size of 25 nm, a variation coefficient of particle size of 12%, and a [100] face ratio of 92%.

<Preparation of Silver Halide Photosensitive Emulsion E>

Silver halide photosensitive emulsion E was prepared in the same manner as in silver halide photosensitive emulsion C except that the temperature on the occasion of the simultaneous mixing was changed to 45° C. Thus obtained emulsion was a monodispersed silver iodide emulsion having an average particle size of 55 nm, a variation coefficient of particle size of 12%, and a [100] face ratio of 92%.

<Preparation of Silver Halide Photosensitive Emulsion F>

Silver halide photosensitive emulsion F was prepared in the same manner as in silver halide photosensitive emulsion D except that the temperature on the occasion of the simultaneous mixing was changed to 45° C. Thus obtained emulsion was a monodispersed silver iodobromide emulsion (AgI content: 90 mole-percent) having an average particle size of 55 nm, a variation coefficient of particle size of 12%, and a [100] face ratio of 92%.

<Preparation of Organic Silver Salt Powder>

In 4720 ml of purified water, 130.8 g of behenic acid, 67.7 g of arachidic acid, 43.6 g of stearic acid, and 2.3 g of palmitic acid were dissolved at 80° C. Next, 540.2 ml of a 1.5 moles/liter aqueous solution of sodium hydroxide added and 6.9 ml of concentrated nitric acid was added, and the resultant solution was cooled by 55° C. to prepare a solution of sodium salt of the fatty acids. To the solution of sodium salt of the fatty acids, the photosensitive silver halide emulsion (the kind and amount is shown in Table 2) and 450 ml of purified water was added and stirred for 5 minutes.

Next, 468.4 ml of a 1 mole/liter silver nitrate solution was added and stirred for 10 minutes to obtain an organic silver salt dispersion. After that, the obtained organic silver salt was moved into a washing vessel, and deionized water was added and stirred. And then, the system was stood for separating the organic silver salt dispersion by coming to the liquid surface and the water-soluble salts in the lower layer was removed. Thereafter, the organic silver salt was repeatedly subjected to washing by deionized water and exhausting water until the electroconductivity of the exhausted water was attained to 2 μS/cm, and dehydrated by centrifugation. Thus obtained cake of the organic silver salt was dried for attaining the moisture content to 0.1% by a gas flowing type dryer Flush Jet Dryer, manufactured by Seishin Seiki Co., Ltd., while controlling the operating condition such as the nitrogen gas atmosphere and the temperature of hot blowing at the intake of the dryer, to obtain dried organic silver salt powder. According to the observation by an electron micrometer on the later-mentioned heat-developable photosensitive material 1 using this organic silver salt, the organic silver salt was a planar particle having an average diameter (circle corresponding diameter) of 0.08 μm, an aspect ratio of 5 and a monodispersion degree of 10%.

An infrared moisture meter was used for measuring the moisture content of the organic silver salt composition.

<Preparation of Pre-Dispersed Dispersion>

For the binder of the image forming layer, 14.57 g of $SO_3K$ group-containing poly(vinyl butyral) (Tg: 75° C., containing 0.2 millimoles/g of —$SO_3K$ group) was dissolved in 1457 g of MEK, and 500 g of the above organic silver salt powder is gradually added while stirring by a dissolver Dispermat CA-40M, manufactured by VMA-Getzmann Co., Ltd., for sufficiently mixing to prepare a pre-dispersed dispersion.

<Preparation of Photosensitive Emulsion Dispersion>

The pre-dispersed dispersion was supplied by a pump to a media type dispersing machine Dispermat SL-C12EX, manufactured by VMA-Gtezmann Co., Ltd., which was filled by 80% of volume by zirconia beads (Torecelum: Toray Co., Ltd.) so that the staying time in the mill was 1.5 minutes, and was dispersed at a circumference rate of the mill of 8 m/s to a photosensitive emulsion dispersion.

<Preparation of a Stabilizer Solution>

In 4.97 g of methanol, 1.0 g of the stabilizing agent 1 and 0.31 g of potassium acetate was dissolved to prepare a stabilizer solution.

<Preparation of 2-chlorobenzoic Acid Solution>

In a dark place, 1.488 g of 2-chlorobenzoic acid, 2.779 g of Stabilizing agent 2 and 365 mg of 5-methyl-2-mercaptobenzimidazole were dissolved in 31.3 ml of MEK to prepare a 2-chlorobenzoic acid solution.

<Preparation of Additive Solution a>

In 110 g of MEK, the reducing agent (the compound (reducing agent) and its amount described in Table 2) and 0.159 g of yellow color forming leuco dye (YA-1), 0.159 g of cyan color forming leuco dye (CA-10) and 1.54 g of 4-methylphthalic acid were dissolved to prepare additive solution a.

<Preparation of Additive Solution b>

In 40.9 g of MEK, 1.56 g of fog inhibitor 2, 0.5 g of fog inhibitor 3, 0.5 g of fog inhibitor 4, 0.5 g of fog inhibitor 5 and 3.43 g of phthaladine were dissolved to prepare additive solution b.

<Preparation of Additive Solution c>

In 39.99 g of MEK, 0.01 g of the silver saving agent was dissolved to prepare additive solution c.

<Preparation of Additive Solution d>

In 9.0 g of MEK, 0.5 g of potassium p-touenethiosulfonate and fog inhibitor 6 were dissolved to prepare additive solution d.

<Preparation of Additive Solution e>

In 9.0 g of MEK, 1.0 g of vinylsulfon [$CH_2{=}CH{-}SO_2CH_2]_2CHOH$] was dissolved to prepare additive solution e.

<Preparation of Image Forming Layer Coating Liquid>

In an inactive gas atmosphere (97% of nitrogen), 50 g of the photosensitive emulsion dispersion 1 and 15.11 g of MEK were kept at 21° C. while stirring, and 1000 μl of chemical sensitizer S-5 (0.5% methanol solution) was added and, after 2 minutes, 390 μl of fog inhibitor 1 (10% methanol solution) was added and stirred for 1 hour. After that, 494 μl of calcium bromide (10% methanol solution) was added and stirred for 10 minutes, and 494 μl of calcium bromide (10% methanol solution) was further added and stirred for 10 minutes. And then gold sensitizer Au-5 in an amount corresponding to 1/20 in mole of the organic chemical sensitizer was added and stirred for 20 minutes, and 167 ml of the stabilizer solution was added and stirred for 10 minutes, and then 1.32 g of the 2-chlorobenzoic acid solution was added and stirred for 1 hour. Thereafter, the liquid temperature was lowered by 13° C. and stirred for 30 minutes. Further, 0.5 g of additive solution d, 0.5 g of additive solution e and 13.31 g of the binder the same as that employed in the predispersed dispersion was added and stirred for 30 minutes and 1.084 g of tetrachlorophthalic acid (9.4% MEK solution) was added and stirred for 15 minutes while keeping the temperature at 13° C. While continuously stirring, 12.43 g of additive solution a, 1.6 ml of an aliphatic isocyanate Desmodur N3300, manufactured by Moubey Co., Ltd., 4.27 g of additive solution b and 1.0 g of additive solution c were successively added and stirred to prepare an image forming layer coating liquid.

The structures of the additives such as the stabilizing agent and others employed in the each of the coating liquids and the image forming layer coating liquid are listed below.

Chemical Sensitizer S-5

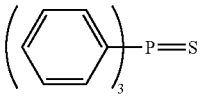

-continued

Au-5

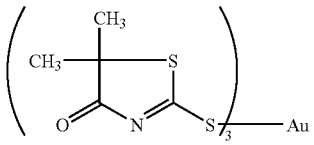

Fog Inhibitor 1

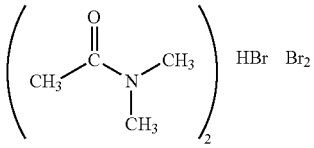

Fog Inhibitor 3

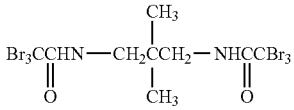

Fog Inhibitor 4

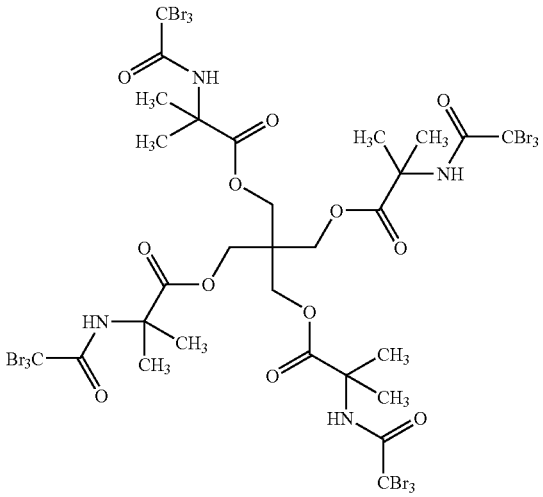

Fog Inhibitor 5

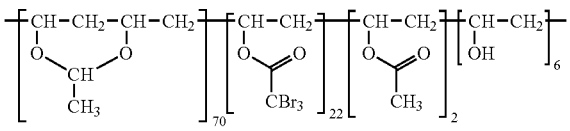

Average Molecular Weight 20,000

Stabilizer 1

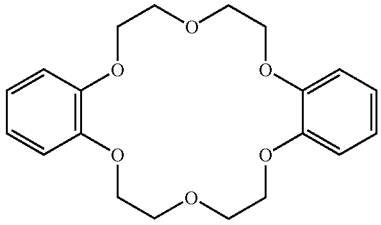

Stabilizer 2

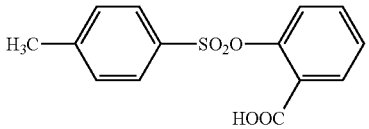

Fog Inhibitor 2

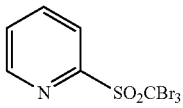

-continued

Fog Inhibitor 6

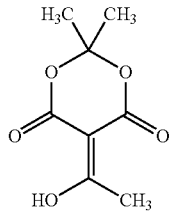

Silver Saving Agent

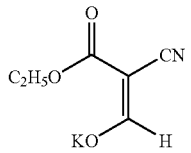

<Preparation of Image Forming Layer Lower Protective Layer (Lower Surface Protective Layer)>

Into 500 g of acetone, 2,100 g of MEK and 700 g of methanol, 230 g of cellulose acetate-propionate (CAB-171-15S, Eastman Chemical Co., Ltd.) was added and stirred and dissolved by a dissolver. To the resultant solution, 25 g of phthaladine, 3.5 g of $CH_2{=}CHSO_2CH_2CH_2OCH_2CH_2SO_2CH{=}CH_2$, 1 g of $C_{12}F_{25}(CH_2CH_2O)_{10}C_{12}F_{25}$, 1 g of SF-17, 10 g of stearic acid and 10 g of butyl stearate were added while stirring and dissolved. Finally, 140 g of monodispersed silica having a monodispersed degree of 15% (average particle size: shown in Table 2, and surface treated by aluminum in an amount of 1% of the silica) dispersed in MEK in a concentration of 5% was added and stirred to prepare an image forming layer protective lower layer coating liquid.

<Preparation of Image Forming Layer Upper Protective Layer (Upper Surface Protective Layer)>

Into 500 g of acetone, 2,100 g of MEK and 700 g of methanol, 230 g of cellulose acetate-propionate (CAB-171-15S, Eastman Chemical Co., Ltd.) was added and stirred and dissolved by a dissolver. To the resultant solution, 25 g of phthaladine, 3.5 g of $CH_2{=}CHSO_2CH_2CH_2OCH_2CH_2SO_2CH{=}CH_2$, 1 g of $C_{12}F_{25}(CH_2CH_2O)_{10}C_{12}F_{25}$, 1 g of SF-17, 10 g of stearic acid and 10 g of butyl stearate were added while stirring and dissolved. Finally, 280 g of monodispersed silica having a monodispersed degree of 15% (average particle size: shown in Table 2, and surface treated by aluminum in an amount of 1% of the silica) dispersed in MEK in a concentration of 5% was added and stirred to prepare an image forming layer protective upper layer coating liquid.

<Preparation of Heat-Developable Photosensitive Material>

The above prepared back-coat layer coating liquid and the back-coat protective layer coating liquid were coated on the subbing layer B-2 by an extrusion coater at a coating rate of 50 m/minute so that the dry layer thickness was 3.5 μm. The drying was carried out by air having a dew point of 10° C. spending 10 minutes at a drying temperature of 100° C.

The image forming layer coating liquid and the image forming layer protective layer (surface protective layer) coating liquids were simultaneously coated on the subbing layer A-2 by an extrusion coater at a coating rate of 50 m/minute to prepare photosensitive material Samples 1 through 17 shown in Tables 2 and 3. The coating was carried out so that the coated silver amount in the image forming layer was 1.2 g/m$^2$ and the dried thickness of the image forming layer protective layer (surface protective layer) was 3.0 μm (1.5 μm of surface protective lower layer and 1.5 μm of surface protective upper layer), by drying air having a dew point of 10° C. spending 10 minutes at a temperature of 75° C.

The pH at the surface of the image forming side of the obtained heat-developable photosensitive material was 5.3 and that at the surface of the back-coat side was 5.5.

Sample 9 was prepared in the same manner as in Sample 1 except that 259.9 g of behenic acid was employed in place of the 130.8 g of behenic acid, 67.7 g of arachidic acid, 43.6 g of stearic acid and 2.3 g of palmitic acid.

Sample 10 was prepared in the same manner as in Sample 1 except that 540.2 ml of a 1.5 moles/liter potassium hydroxide solution was employed in the preparation of the organic silver salt powder A in place of 540.2 ml of a 1.5 moles/liter sodium hydroxide solution.

Sample 11 was prepared in the same manner as in Sample 1 except that the fluorosurfactant SF-17 in the back-coat layer protective layer and image forming layer protective layer was replaced by $C_8F_{17}SO_3Li$.

Sample 12 was prepared in the same manner as in Sample 1 except that the $SO_3K$ group-containing poly(vinyl butyral) (Tg: 75° C., $SO_3K$ content: 0.2 millimoles/g) in the preparation of the pre-dispersed dispersion A was replaced by $SO_3K$ group-containing poly(vinyl butyral) (Tg: 65° C., $SO_3K$ content: 0.2 millimoles/g).

<Exposure and Developing Treatment>

The above-prepared heat-developable Samples 1 through 17 of photosensitive material were cut into half cut size (34.5 cm×43.0 cm) and treated by the following procedure employing the thermal development apparatus shown in FIG. 1.

The heat-developable photosensitive material sample was taken out from the film tray, conveyed to the laser exposing part and exposure was given from the image forming layer side by a exposing device having a semiconductor laser (NLHV 3000E manufactured by Nichia Kagaku Kogyo Co., Ltd.) emitting light of wavelength of 405 nm as the light source. The light amount was varied within the range of from 0 to 1,000 mW/mm$^2$. After that the heat-developable photosensitive material was conveyed to the thermal developing part and subjected to thermal development at 123° C. for 13.5 seconds by touching the heating drum with the protective layer of the image forming layer side of the heat-developable photosensitive material and then taken out from the apparatus. The conveying rate from the photosensitive material supplying part to the imagewise exposing part and that in the thermal developing part were each 20 mm/sec. The exposure and the development were performed in a room conditioned at 23° C. and 50% RH. The exposure was stepwise carried out in which the exposure energy was reduced step by step from the largest exposing energy by a rate of log E 0.05 per step.

<Packaging Material>

PET 10 μm/PET 12 μm/aluminum 9 μm/Ny 15 μm/polyethylene 50 μm containing 3% of carbon, oxygen permeation ratio: 0 ml/atm·m$^2$·25° C.·day, moisture permeation ratio: 0 g/atm·m$^2$·25° C.·day. A paper tray was used.

<Evaluation on Characteristics>

The following characteristics were evaluated with respect to the thermally developed image.

<<Image Density>>

The density of the maximum density portion of the image obtained by the above conditions was measured by a densitometer and represented as the image density.

<<Mean Gradient>>

The image density of thus obtained sensitometry sample was measured by a transmission densitometer PDM65, manufactured by Konica Corp., and the measured results were processed by a computer to draw a characteristic curve. The mean gradient y (Ga) between the optical densities of 0.25 and 2.5 was determined.

<<Conveying Ability>>

Fifty times of processing were repeated by the thermal processing apparatus and the number of occurrence of the fault in the conveyance was measured.

<<Density Unevenness Formed by Thermal Development>>

The density unevenness formed by the thermal development was visually evaluated according to the following norms.

5: Density unevenness was not observed.

4: Density unevenness slightly occurred.

3: Weak density unevenness partially occurred.

2: Intense density unevenness partially occurred.

1: Intense density unevenness occurred overall.

<<Fogging by Aging>>

The above-prepared heat-developable photosensitive materials were closed in a sealable container in which the temperature and the humidity were kept at 25° C. and 55%, and stored for 7 days at 55° C. (forcibly aging). For comparison, the same heat-developable photosensitive materials were stored for 7 days at a temperature of 25° C. and humidity of 55% in a light shielding container. These samples were treated in the same manner as in the sensitometry evaluation and the density of the fogging portion was measured.

The increasing of fog by the aging was calculated according to the following expression for evaluating the aging fog of the heat-developable photosensitive materials.

$$\Delta D_{min}(\text{increasing of fog})=\text{Fog after forcing aging}-\text{Fog after comparative aging}$$

<<Rz(E)/Rz(B)>><<Ra(E)/Ra(B)>><<Rz(E)/Ra(E)>>

Rz and Ra of the samples before the thermal development were measured by a non-contact three-dimensional surface analyzing apparatus RST/Plus manufactured by WYKO Co., Ltd., under the following conditions.

1. Objective lens:×10.0, Intermediate lens:×1.0
2. Measuring range: 463.4 μm×623.9 μm
3. Pixel size: 368×238
4. Filter: Cylindrical calibration and slant calibration
5. Smoothing: Medium smoothing
6. Scanning speed: Low The definitions of Rz and Ra are according to JIS B0601 Surface Roughness. Each of the samples of size of 10 cm×10 cm was grid-wise divided every 1 cm into 100 sections and the measurement was performed at the center of each of the sections and the average value of the 100 values of the measurements was calculated. Thus Rz(E), Rz(B), Ra(E) and Ra(B) were obtained and Rz(E)/Rz(B), Ra(E)/Ra(B) and Rz(E)/Ra(E) were calculated.

Results are listed in Tables 2 and 3.

TABLE 2

| Sample No. | *1 | *2 | *3 | *4 | *5 | Rz (E)/ Rz (B) | Lb/Le | Ra (E)/Ra (B) | Rz (E)/Ra (E) | Re-marks |
|---|---|---|---|---|---|---|---|---|---|---|
| 1 | C/E = 36.2/9.1 | (1-1) = 4.20 | (2-2) = 23.78 | 10.0 | 3.0 | 0.4 | 3.3 | 0.7 | 14.3 | Inv. |
| 2 | C/E = 36.2/9.1 | (1-1) = 4.20 | (2-2) = 23.78 | 8.0 | 3.0 | 0.6 | 2.7 | 0.8 | 14.0 | Inv. |
| 3 | C/E = 36.2/9.1 | (1-1) = 4.20 | (2-2) = 23.78 | 10.0 | 2.0 | 0.2 | 5.0 | 0.6 | 12.6 | Inv. |
| 4 | C/E = 36.2/9.1 | (1-7) = 4.20 | (2-2) = 23.78 | 10.0 | 3.0 | 0.4 | 3.3 | 0.7 | 14.4 | Inv. |
| 5 | C/E = 36.2/9.1 | (1-10) = 4.20 | (2-2) = 23.78 | 10.0 | 3.0 | 0.4 | 3.3 | 0.7 | 14.3 | Inv. |
| 6 | D/F = 36.2/9.1 | (1-1) = 4.20 | (2-2) = 23.78 | 10.0 | 3.0 | 0.4 | 3.3 | 0.7 | 14.1 | Inv. |
| 7 | D/F = 36.2/9.1 | (1-1) = 4.20 | (2-2) = 23.78 | 8.0 | 3.0 | 0.6 | 2.7 | 0.8 | 14.5 | Inv. |
| 8 | D/F = 36.2/9.1 | (1-1) = 4.20 | (2-2) = 23.78 | 10.0 | 2.0 | 0.2 | 5.0 | 0.6 | 14.0 | Inv. |
| 9 | C/E = 36.2/9.1 | (1-1) = 4.20 | (2-2) = 23.78 | 10.0 | 3.0 | 0.4 | 3.3 | 0.7 | 14.4 | Inv. |
| 10 | C/E = 36.2/9.1 | (1-1) = 4.20 | (2-2) = 23.78 | 10.0 | 3.0 | 0.4 | 3.3 | 0.7 | 14.2 | Inv. |
| 11 | C/E = 36.2/9.1 | (1-1) = 4.20 | (2-2) = 23.78 | 10.0 | 3.0 | 0.4 | 3.3 | 0.7 | 14.3 | Inv. |
| 12 | C/E = 36.2/9.1 | (1-1) = 4.20 | (2-2) = 23.78 | 10.0 | 3.0 | 0.4 | 3.3 | 0.7 | 15.2 | Inv. |
| 13 | A/B = 36.2/9.1 | (1-1) = 4.20 | (2-2) = 23.78 | 10.0 | 3.0 | 0.4 | 3.3 | 0.7 | 14.4 | Inv. |
| 14 | C/E = 36.2/9.1 | (1-1) = 4.20 | (2-2) = 23.78 | 7.0 | 4.0 | 0.8 | 1.8 | 1.2 | 17.6 | Comp. |
| 15 | D/F = 36.2/9.1 | (1-1) = 4.20 | (2-2) = 23.78 | 7.0 | 4.0 | 0.8 | 1.8 | 1.2 | 17.4 | Comp. |
| 16 | C/E = 36.2/9.1 | (1-1) = 4.20 | (2-2) = 23.78 | 12.0 | 1.0 | 0.04 | 12.0 | 0.4 | 8.6 | Comp. |
| 17 | D/F = 36.2/9.1 | (1-1) = 4.20 | (2-2) = 23.78 | 12.0 | 1.0 | 0.04 | 12.0 | 0.4 | 8.8 | Comp. |

Inv.: Inventive
Comp.: Comparative
*1: Kind and amount (g) of photosensitive silver halide emulsion
*2: Kind and amount (g) of reducing agent of Formula 1
*3: Kind and amount (g) of reducing agent of Formula 2
*4: Average particle size of silica (Lb) (μm) in back-coat layer protective layer
*5: Average particle size of silica (Le) (μm) in image forming layer protective layer (upper layer/lower layer)

TABLE 3

| Sam-ple No. | Image density | Mean gamma | Fog increasing by aging | Conveying ability | Density unevenness after thermal development | Re-marks |
|---|---|---|---|---|---|---|
| 1 | 4.2 | 2.7 | 0.002 | 0 | 5.0 | Inv. |
| 2 | 4.2 | 2.7 | 0.003 | 0 | 4.5 | Inv. |

TABLE 3-continued

| Sample No. | Image density | Mean gamma | Fog increasing by aging | Conveying ability | Density unevenness after thermal development | Remarks |
|---|---|---|---|---|---|---|
| 3 | 4.2 | 2.7 | 0.003 | 0 | 4.5 | Inv. |
| 4 | 4.2 | 2.7 | 0.002 | 0 | 5.0 | Inv. |
| 5 | 4.6 | 2.9 | 0.003 | 0 | 5.0 | Inv. |
| 6 | 4.0 | 2.7 | 0.002 | 0 | 5.0 | Inv. |
| 7 | 4.0 | 2.7 | 0.003 | 0 | 4.5 | Inv. |
| 8 | 4.0 | 2.7 | 0.003 | 0 | 4.5 | Inv. |
| 9 | 4.1 | 2.7 | 0.002 | 0 | 5.0 | Inv. |
| 10 | 4.4 | 2.7 | 0.002 | 0 | 5.0 | Inv. |
| 11 | 4.2 | 2.7 | 0.004 | 1 | 4.5 | Inv. |
| 12 | 4.2 | 2.7 | 0.004 | 1 | 4.5 | Inv. |
| 13 | 3.8 | 2.6 | 0.004 | 1 | 4.0 | Inv. |
| 14 | 3.6 | 2.6 | 0.012 | 6 | 2.5 | Comp. |
| 15 | 3.4 | 2.5 | 0.012 | 6 | 2.5 | Comp. |
| 16 | 3.5 | 2.6 | 0.011 | 5 | 2.5 | Comp. |
| 17 | 3.3 | 2.5 | 0.013 | 6 | 2.5 | Comp. |

Inv.: Inventive
Comp.: Comparative

It is cleared by Tables 2 and 3 that the density is high, the conveying insufficiency and the density unevenness do not occur and the prevention of fog increasing by aging is excellent in the image forming method according to the invention compared with the comparative image forming method.

It is understood by comparison of Sample 1 with Sample 11 that Sample 1 is superior in the conveying ability and the environmental suitability (accumulation in an organism. It is also under stood by comparison of Sample 1 with Sample 12 that Sample 1 is superior in the storage ability of image in the storage at high temperature.

What is claimed is:

1. A heat-developable photosensitive material having an image forming layer containing organic silver salt, silver halide which contains silver iodide in a ratio of from 40 mole-percent to 100 mole-percent, binder and a reducing agent, wherein a value of Rz(E)/Rz(B) is from 0.1 to 0.7 in which Rz(E) is the ten-point average surface roughness of the outermost surface of the image forming layer side on a support and Rz(B) is the ten-point average surface roughness of the outermost surface of the opposite side through the support;

wherein the value of Ra(E)/Ra(B) is from 0.6 to 1.3 when Ra(E) is the center-line average surface roughness of the surface of the image forming layer side and Ra(B) is the center-line average surface roughness of the surface of the opposite side through the support;

the value of Rz(E)/Ra(E) is from 12 to 60; and the value of Lb/Le is from 2.0 to 10 in which Lb is the average particle diameter of the matting agent having the highest average particle diameter contained in a layer on the back coat layer side of the support and Le is the average particle size of a matting agent having the largest average particle size contained in a layer on the opposite side through the support.

2. The heat-developable photosensitive material of claim 1, wherein a value of Rz(E)/Rz(B) is from 0.2 to 0.6.

3. The heat-developable photosensitive material of claim 2, wherein the value of Rz(E)/Rz(B) is from 0.3 to 0.5.

4. The heat-developable photosensitive material of claim 1, a silver saving agent selected from the group consisting of a vinyl compound, a hydrazine derivative, a phenol derivative, a naphthol derivative, a silane compound and a quaternary opium compound is contained in the image forming layer side.

5. The heat-developable photosensitive material of claim 1, wherein the glass transition point (Tg) of the binder is from 70 to 150° C.

6. The heat-developable photosensitive material of claim 1, wherein the heat-developable photosensitive material contains a compound represented by Formula SF;

$$(Rf(L)n1)p(Y)m1(A)q \qquad \text{Formula SF}$$

in which Rf is a substituent having a fluorine atom, L is a di-valent linking group having no fluorine atom, Y is a (p+q)-valent linking group having no fluorine atom, A is an anionic group or its salt, m1 and n1 are each an integer of 0 or 1 and p and q are each an integer of 1 to 5, provided that n1 and m1 are not simultaneously 0 when q is 1.

7. The heat-developable photosensitive material of claim 1, wherein the silver halide contains silver halide grains having an average grain size of from 10 to 50 nm.

8. The heat-developable photosensitive material of claim 1, wherein the silver halide further contains silver halide grains having an average grain size of from 55 to 100 nm.

9. The heat-developable photosensitive material of claim 1, wherein the silver halide contains a silver halide grain chemically sensitized by a chalcogen compound.

10. The heat-developable photosensitive material of claim 1, wherein the amount of silver contained in the image forming layer is from 0.3 to 1.5 g/m$^2$.

11. An image forming method, wherein the heat-developable photosensitive material of claim 1 is exposed by a light source of a laser having an emission peak at 350 nm to 450 nm.

12. The image forming method of claim 11, wherein a mean gradient, gamma is from 2.0 to 4.0 between optical diffuse densities of 0.25 to 2.5 on the characteristic curve of the image formed by thermal development at a developing temperature of 123° C. and a time of 13.5 seconds, the characteristiC curve is drawn on an orthogonal coordinate in which the diffuse density (Y-axis) and common logarithm of exposure amount (X-axis) are measured in the same unit length.

13. The image forming method of claim 11, after the material is exposed by a light source, it is subjected to a thermal development wherein the thermal development is carried out by the use of a thermal developing apparatus at a conveying rate in a developing part of from 10 to 200 mm/seconds, a conveying rate between a photographic material supplying part to a imagewise exposing part of from 10 to 200 mm/second and a conveying rate in the imagewise exposing part of from 10 to 200 mm/second.

14. The image forming method of claim 11, wherein the heat-developable photosensitive material is exposed to light having an illuminance of not less than 1 mW/mm$^2$.

* * * * *

UNITED STATES PATENT AND TRADEMARK OFFICE

CERTIFICATE OF CORRECTION

PATENT NO. : 7,262,001 B2
APPLICATION NO. : 11/045758
DATED : August 28, 2007
INVENTOR(S) : Goto It is certified that error appears in the above-identified patent and that said Letters Patent is hereby corrected as shown below:

Title Page, left column, under "(*) Notice:", delete "This patent is subject to a terminal disclaimer".

Signed and Sealed this

Eighteenth Day of December, 2007

JON W. DUDAS
*Director of the United States Patent and Trademark Office*